US007185949B2

(12) United States Patent
Finell

(10) Patent No.: US 7,185,949 B2
(45) Date of Patent: Mar. 6, 2007

(54) HIGHCHAIR

(76) Inventor: Rebecca M. Finell, 1152 E. Cottonwood La., Phoenix, AZ (US) 85048

( * ) Notice: Subject to any disclaimer, the term of this patent is extended or adjusted under 35 U.S.C. 154(b) by 0 days.

(21) Appl. No.: 11/429,095

(22) Filed: May 5, 2006

(65) Prior Publication Data

US 2007/0029847 A1 Feb. 8, 2007

Related U.S. Application Data

(60) Provisional application No. 60/700,466, filed on Jul. 19, 2005.

(51) Int. Cl.
*A47B 39/00* (2006.01)

(52) U.S. Cl. ..... 297/148; 297/150; 297/174 R; 297/174 CS; 297/136

(58) Field of Classification Search ..... 297/136, 297/135, 148, 150, 160, 161, 174 R, 174 CS
See application file for complete search history.

(56) References Cited

U.S. PATENT DOCUMENTS 3,632,162 A * 1/1972 Trethaway ..... 297/149
4,685,726 A * 8/1987 Wolpert, Jr. ..... 297/150
5,810,432 A * 9/1998 Haut et al. ..... 297/153
6,126,236 A * 10/2000 Wu ..... 297/325
6,419,312 B1 * 7/2002 Flannery et al. ..... 297/149
6,692,070 B1 * 2/2004 Hou et al. ..... 297/153
6,932,426 B2 * 8/2005 Greger ..... 297/149

* cited by examiner

*Primary Examiner*—Peter M. Cuomo
*Assistant Examiner*—Erika Garrett
(74) *Attorney, Agent, or Firm*—Parsons & Goltry; Michael W. Goltry; Robert R. Parsons

(57) ABSTRACT

A highchair includes a seat attached to a frame having a first periphery defining a first footprint of the frame. Wheels are attached to the frame adjacent to the first periphery for providing wheeled movement of the frame over a surface. The first periphery of the frame bounds a receiving area underlying the frame within the first footprint of the frame. An arresting fixture is located in the receiving area and has a second periphery defining a second footprint of the arresting fixture within the first footprint of the frame. The arresting fixture is mounted to the frame for movement in reciprocal directions relative to the frame between a first position toward the frame, and a second position away from the frame for engagement with the surface for arresting the frame from wheeled movement over the surface.

27 Claims, 17 Drawing Sheets

64
101
120
122
122A
122B
126
127
131
132
133
150
151
152
153
154
155
156
157
160
161
170
171
172
173
175
176
177
178
180
181
185
186
190
191
200
200A
200B
200C
201
B
C
G
H

HIGHCHAIR

CROSS REFERENCE TO RELATED APPLICATION

This application claims the benefit of U.S. Provisional Application No. 60/700,466, filed Jul. 19, 2005.

FIELD OF THE INVENTION

The present invention relates to highchairs.

BACKGROUND OF THE INVENTION

The prior art is replete with highchairs for use in feeding toddlers. A typical highchair incorporates a seat associated with a harness or other mechanism used to secure a child to the seat when seated thereon. Some highchairs incorporate a feeding tray that may be engaged to the seat. Other highchairs incorporate a wheeled frame for providing wheeled movement of the highchair. Folding highchairs are designed to collapse and quickly fold away when not in use. Wooden cube-style highchairs convert into a low table and chair. This type of highchair is bulky but generally a good value. Wooden one-piece raised chairs are more traditional and often more attractive to look at, but they have fewer features, are less flexible and take up more space. Booster-style highchairs are small units designed to secure onto a table or household chair to create an alternative to a highchair. Booster-style highchairs are very portable, require less space and are inexpensive but require careful securing and have fewer features.

The prior art has provided numerous specific configurations of highchairs. None, however, have proven to be entirely satisfactory. Many are difficult to construct, and expensive. Others incorporate cumbersome latch mechanisms that make it difficult to attach and remove the tray relative to the seat. Other high chairs incorporate feeding trays that are relatively easy to install onto a spout, but also easily fall off. Still others utilize complicated and cumbersome harness assemblies used to secure the child to the seat. Some prior art highchairs incorporating wheels for allowing the highchair to be wheel about do not provide a way to lock the highchair preventing to prevent it from rolling. Those high chairs incorporating mechanisms for arresting wheeled movement are either difficult to construct, difficult to use, cumbersome, ineffective, or dangerous.

SUMMARY OF THE INVENTION

It would be highly advantageous, therefore, to remedy the foregoing and other deficiencies inherent in the prior art. Accordingly, it is an object of the present invention to provide a highchair incorporating a seat carried by a wheeled frame which is low in cost, which is safe, which includes an arresting fixture for arresting the frame from wheeled movement over a surface, which includes a cylinder assembly coupled between the seat and the frame and which is used to conveniently raise and lower the seat relative to the frame, and which includes mechanisms for operating the arresting fixture and the cylinder assembly, in accordance with the principle of the invention.

Briefly, to achieve the objects and advantages of the instant invention, in accordance with a preferred embodiment thereof, a highchair includes a seat attached to a frame having a top, a bottom, and a first periphery defining a first footprint of the frame. Wheels are attached to the frame adjacent to the first periphery for providing wheeled movement of the frame over a surface. The first periphery of the frame bounds a receiving area underlying the bottom of the frame within the first footprint of the frame. An arresting fixture has a second periphery defining a second footprint of the arresting fixture. The second footprint of the arresting fixture is smaller than the first footprint of the frame. The arresting fixture is located in the receiving, and the second footprint is within the first footprint of the frame and is encircled by the wheels. The arresting fixture is mounted to the frame for movement in reciprocal directions relative to the bottom of the frame between a first position toward the bottom of the frame, and a second position away from the bottom of the frame for engagement with the surface for arresting the frame from wheeled movement over the surface.

A mechanism interacting between the frame and the arresting fixture is used to move the arresting fixture between the first and second positions. Preferably, the mechanism interacting between the frame and the arresting fixture for moving the arresting fixture between the first and second positions includes a lever mounted to the frame for pivotal movement, and a linkage assembly coupled between the lever, the frame, and the arresting fixture, whereby pivotal movement of the lever urges corresponding reciprocal movement of the arresting fixture between the lowered and raised positions. To secure the arresting fixture in the raised position, there is at least one element carried by one of the linkage assembly and the arresting fixture, and at least one complemental element carried by the frame, whereby the first element is adapted to interact with the second element in the raised position of the arresting fixture for securing the arresting fixture in the raised position.

A cylinder assembly is coupled between the seat and the frame, and is movable between an engaged position for permitting movement of the cylinder assembly between retracted and extended conditions for moving the seat between lowered and raised positions, respectively, and a secured position for securing the cylinder assembly at a predetermined length. To move the cylinder assembly between the engaged and secured positions, the cylinder assembly incorporates a switch movable between a first position for placing the cylinder assembly in the engaged position and a second position for placing the cylinder assembly in the secured position. A pedal is operatively coupled to the switch, whereby movement of the pedal urges corresponding movement of the switch between its first and second positions. Preferably, a lever is the mechanism interacting between the pedal and the switch.

The arresting fixture consists of a broad, heavy plate including a parametric edge defining the second periphery of the arresting fixture, and a parametric sidewall depending downwardly from the parametric edge away from the bottom of the frame terminating with a parametric lower end. A resilient, elastomeric, parametric boot applied to the parametric lower end of the arresting fixture is for engaging the surface in the lowered position of the arresting fixture.

The seat has a seat back, a seat bottom attached to the upper end of the cylinder assembly, and first and second arms. A first tray seat is formed in the seat adjacent to the first arm between a top side thereof and the seat bottom, and a second tray seat is formed in the seat adjacent to the second arm between a top side thereof and the seat bottom. A tray, having first and second sides, is adapted to sit in the first and second tray seats and extend between the arms of the seat, in which the first tray seat is adapted to receive the first side of the tray and the second tray seat is adapted to receive the second side of the tray. A first latch is coupled to the tray and configured to move between a first position engaging the seat securing the first side to the first tray seat and a second position disengaging the seat releasing the first side from the first tray seat. A second latch is also coupled to the tray and configured to move between a first position engaging the seat securing the second side to the second tray seat and a second position disengaging the seat releasing the second arm from the second tray seat.

The seat is fashioned with a crotch post positioned between the first and second arms. The crotch post has a lower end rigidly affixed to the seat bottom, and projects upwardly therefrom to an opposing free upper end.

Consistent with the foregoing summary of the invention, and the ensuing detailed description, which are to be taken together, the invention also contemplates associated embodiments.

BRIEF DESCRIPTION OF THE DRAWINGS

Referring to the drawings.

DETAILED DESCRIPTION OF PREFERRED EMBODIMENTS

Figure 1:
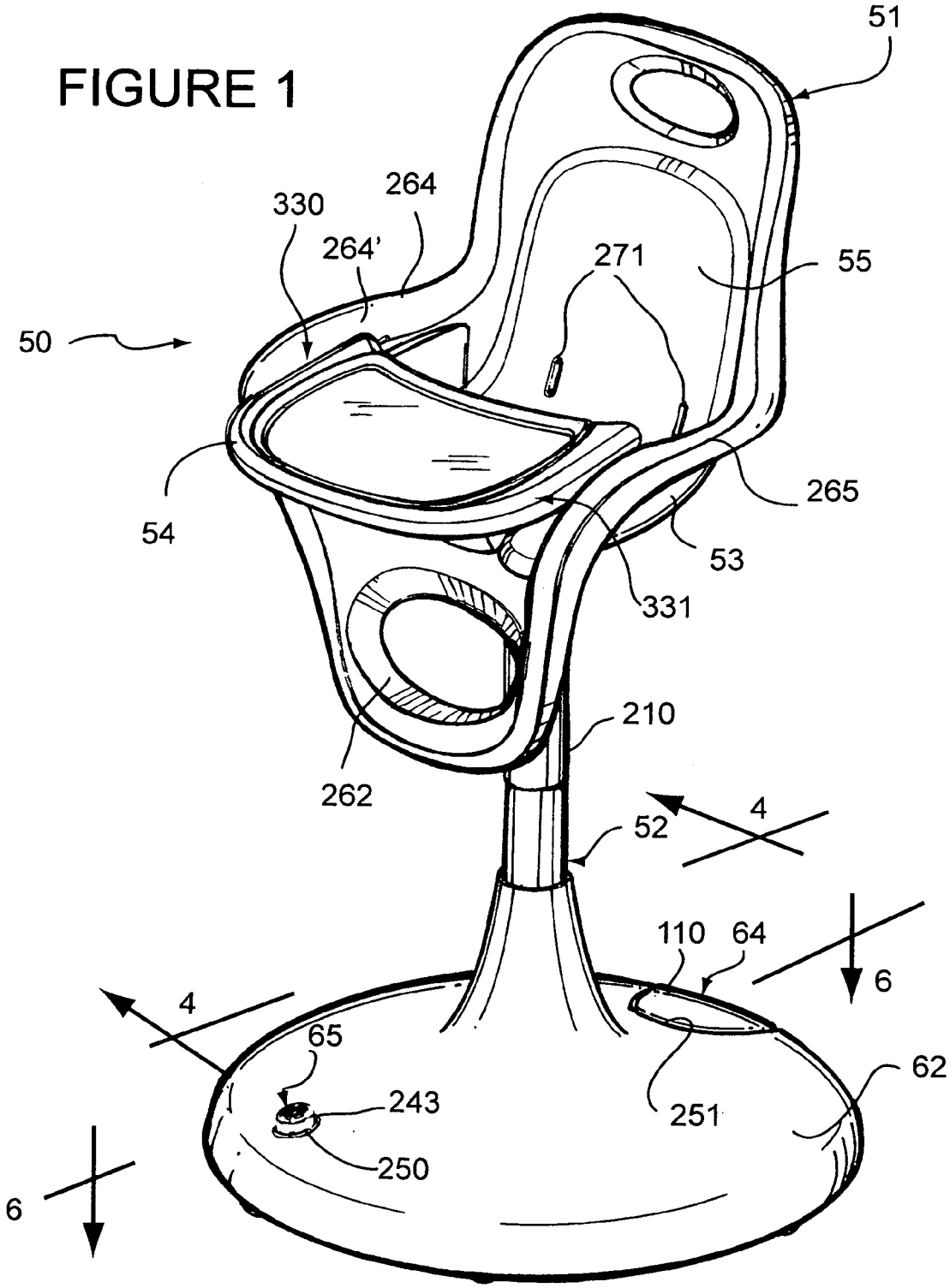
FIG. 1 is a perspective view of a high chair constructed and arranged in accordance with the principle of the invention, the high chair including a seat assembly supported by a base at an elevated location.

Turning now to the drawings, in which like reference characters indicate corresponding elements throughout the several views, attention is first directed to FIG. 1 in which there is seen a high chair, embodying the principles of the instant invention and generally designated by the reference character 50. High chair 50 includes a seat assembly 51 supported by a base 52 at an elevated location. Seat assembly 51 generally consists of a seat 53 for accommodating a toddler in a seated position, and a tray 54. In FIG. 1, a seat pad 55 is positioned on seat 53 onto which a toddler is to be received in a seated position providing comfortable seating. Seat pad 55 is fashioned of foam, foam rubber, or the like, can be removed, if desired, and is considered part of seat 53 when positioned thereon.

Figure 2:
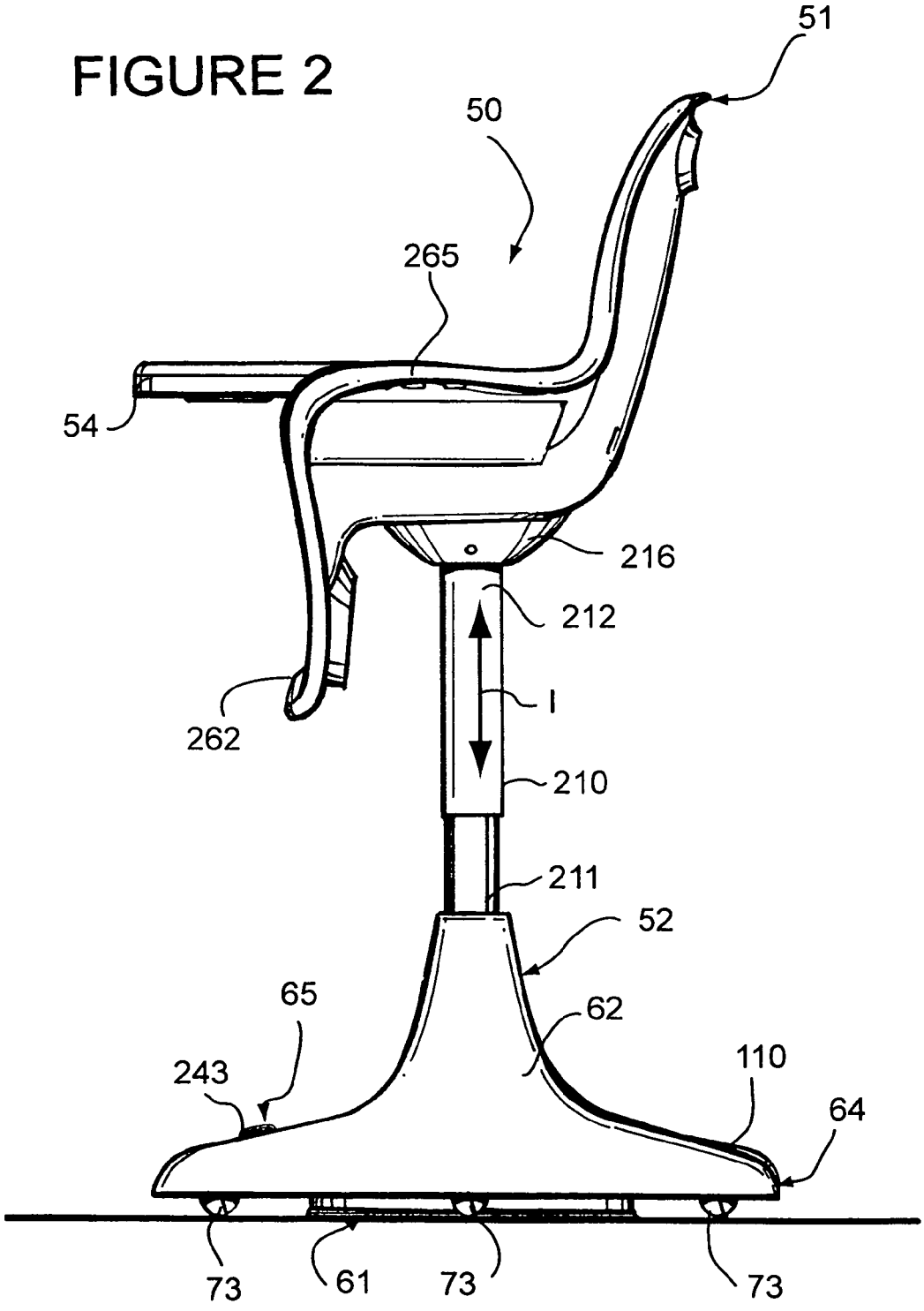
FIG. 2 is a side elevational view of the high chair of FIG. 1, illustrating an arresting fixture thereof shown as it would appear in an arresting position.
Figure 3:
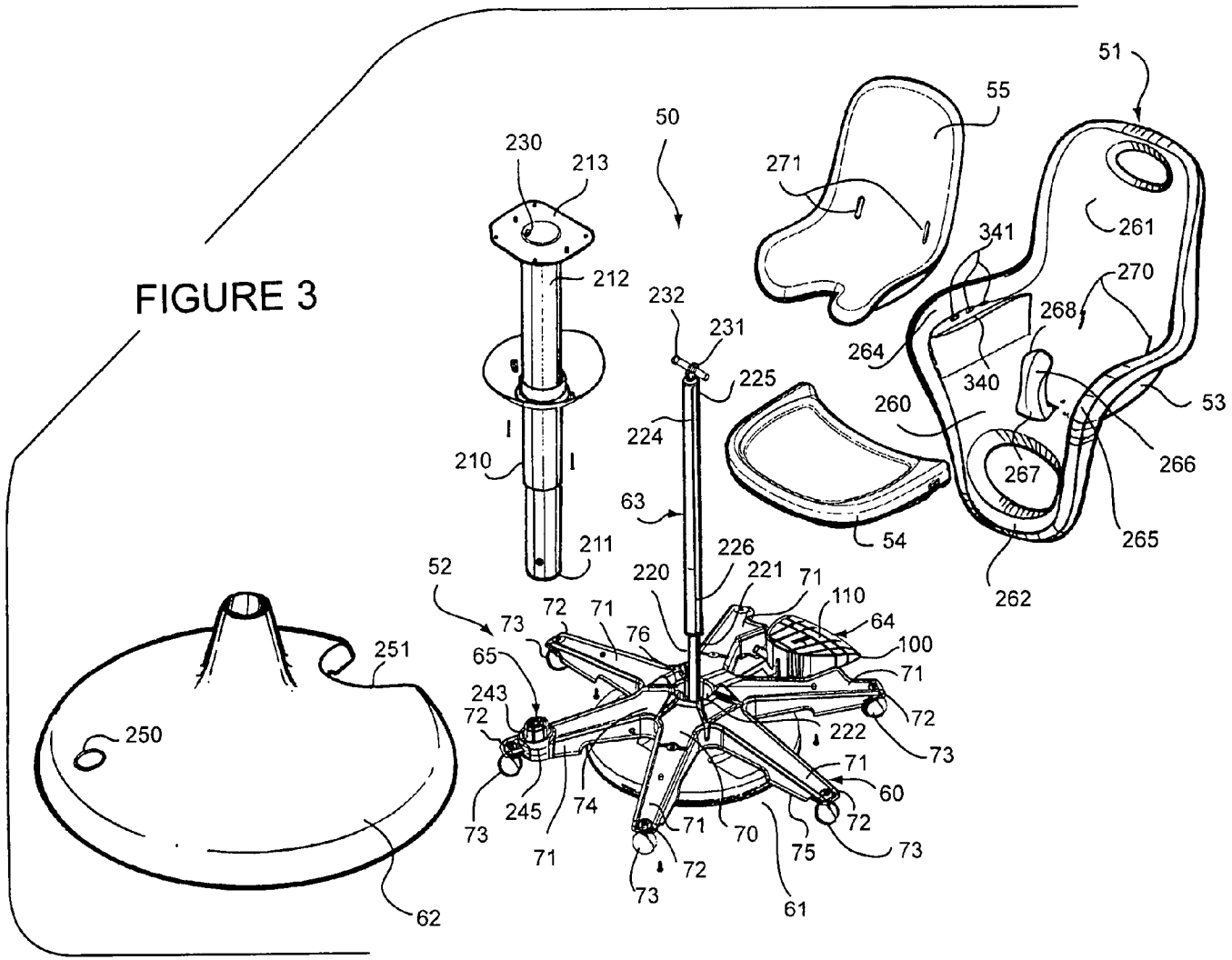
FIG. 3 is an exploded perspective view of the high chair of FIG. 1.

FIG. 3 is an exploded perspective view of high chair 50 illustrating the main components thereof, namely, seat assembly 51 including seat 53 and tray 54 and seat pad 55, and base 52 including a frame 60, an arresting fixture 61, a base cover 62, a cylinder assembly 63, a telescoping support 210, an arresting fixture adjustment assembly/mechanism 64 for moving arresting fixture 61 between stored and arresting positions, and a cylinder assembly actuating assembly/mechanism 65 for moving cylinder assembly 63 between engaged and secured positions, in accordance with the principle of the invention. For illustrative purposes, FIG. 2 is a side elevational view of the highchair of FIG. 1, illustrating the arresting fixture of FIG. 3 as it would appear in its arresting position.

Figure 4:
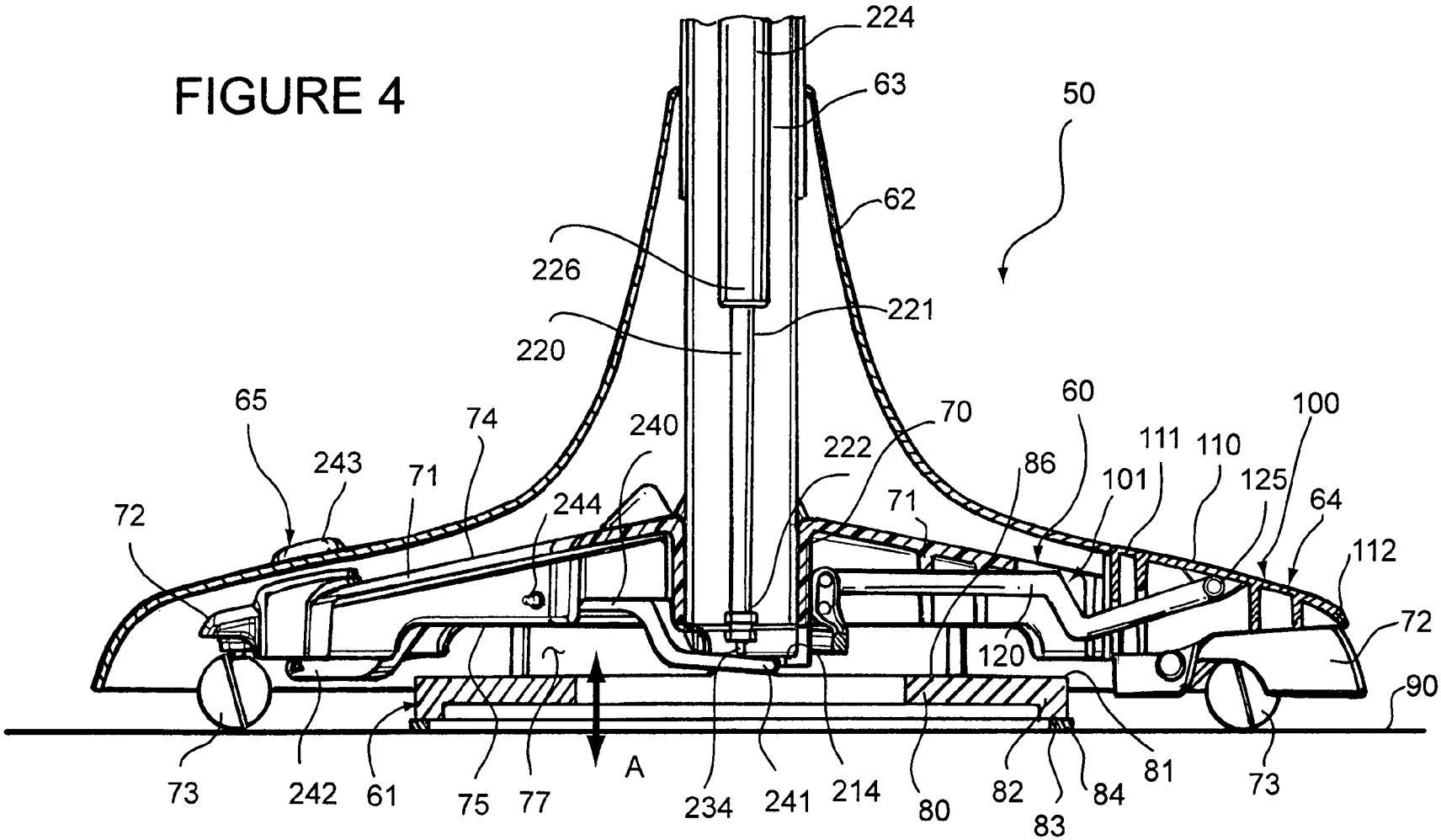
FIG. 4 is a sectional view taken along line 4—4 of FIG. 1.
Figure 10:
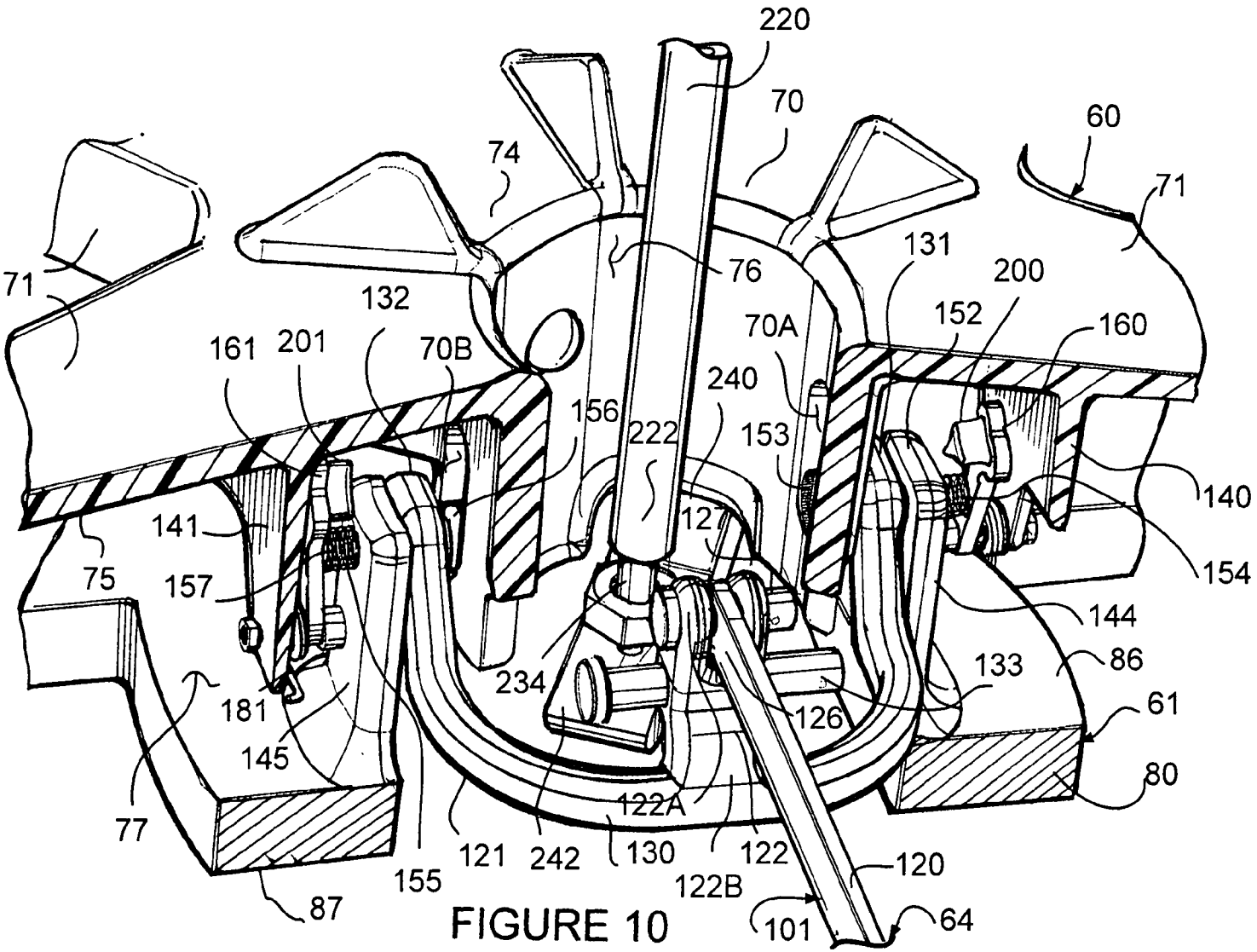
FIG. 10 is fragmented perspective view of the frame and arresting fixture as depicted in FIG. 8 illustrating the linkage assembly coupled between the frame and the arresting fixture.
Figure 11:
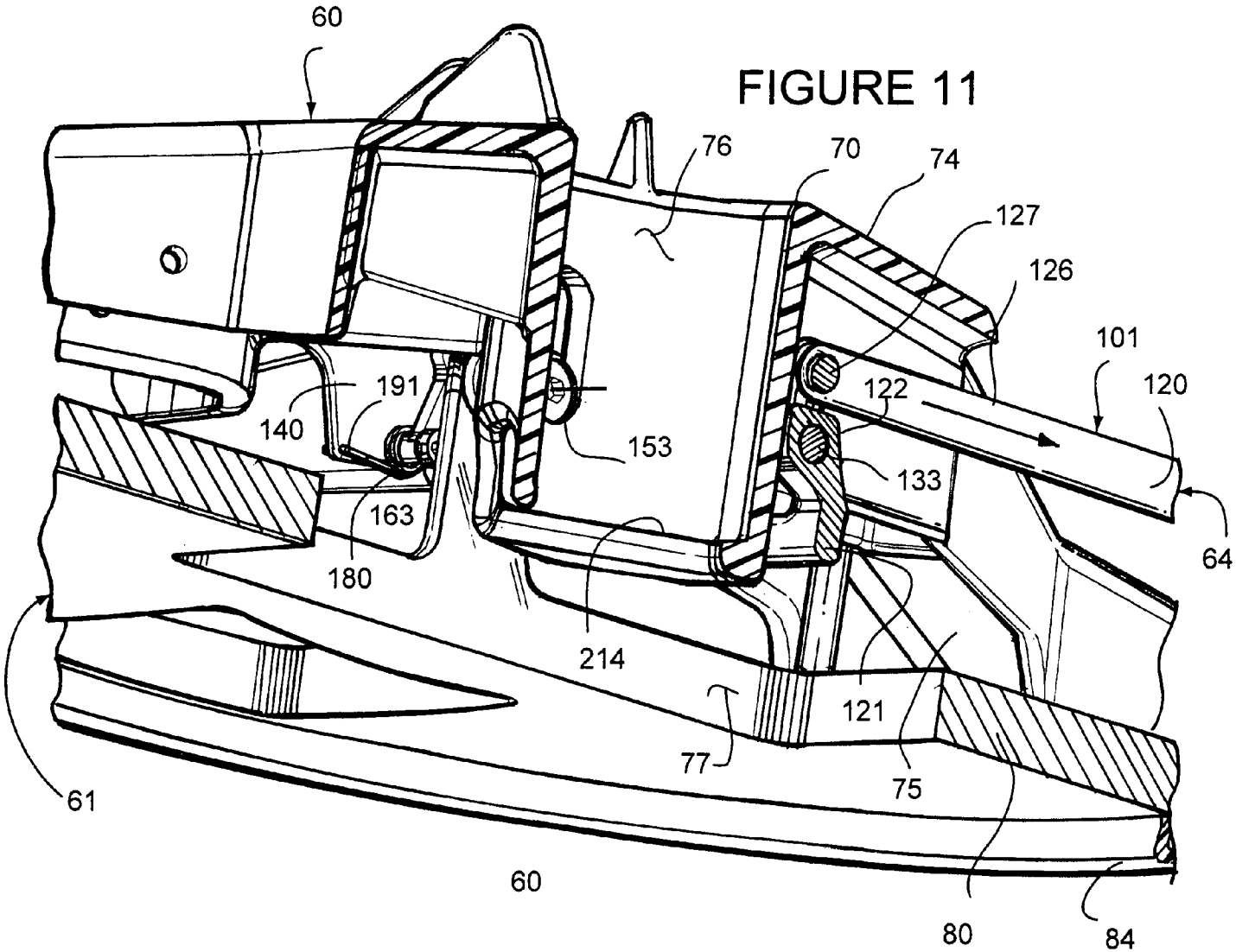
FIG. 11 is a fragmented perspective view of the frame and arresting fixture as depicted in FIG. 10 illustrating the arresting fixture underlying the frame.

Referring to FIG. 3, frame 60 consists of an integrated body formed of steel, aluminum, rigid plastic, or other substantially rigid material or combination of materials. Frame 60 is formed generally in the shape of a star, and includes a central hub 70 connected to legs 71, which project radially outwardly therefrom at spaced-apart circumferential intervals about hub 70 terminating with outer ends 72 each of which carries a wheel 73, such as a roller or caster or other form of wheel, for providing wheel movement of frame 60 over a surface. Legs 71 are substantially equal in size and length. Outer ends 72 of legs 71 define a periphery of frame 60, at which wheels 73 are generally located. Frame 60 has a top 74, an opposed bottom 75, and a central opening 76 defined by hub 70, which is also depicted in FIGS. 10 and 11. The periphery of frame 60, which is a generally circular periphery in the instant embodiment, defines a footprint of frame 60. As best seen in FIG. 4, which is a sectional view taken along line 4—4 of FIG. 1, the periphery of frame 60 bounds a receiving area 77 underlying bottom 75 of frame 60 within the footprint of frame 60.

Figure 5:
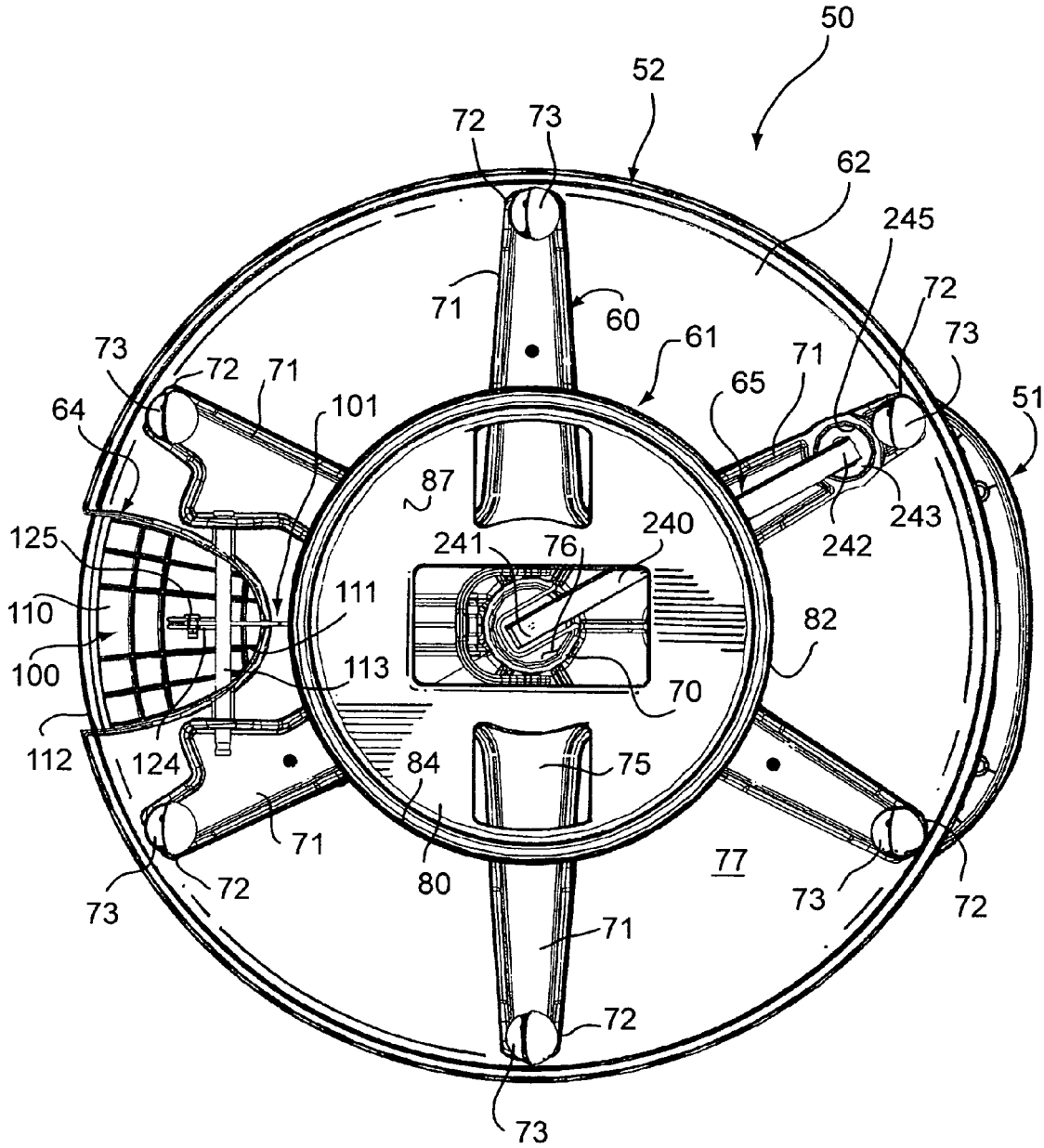
FIG. 5 is a bottom plan view of the high chair of FIG. 1.
Figure 7:
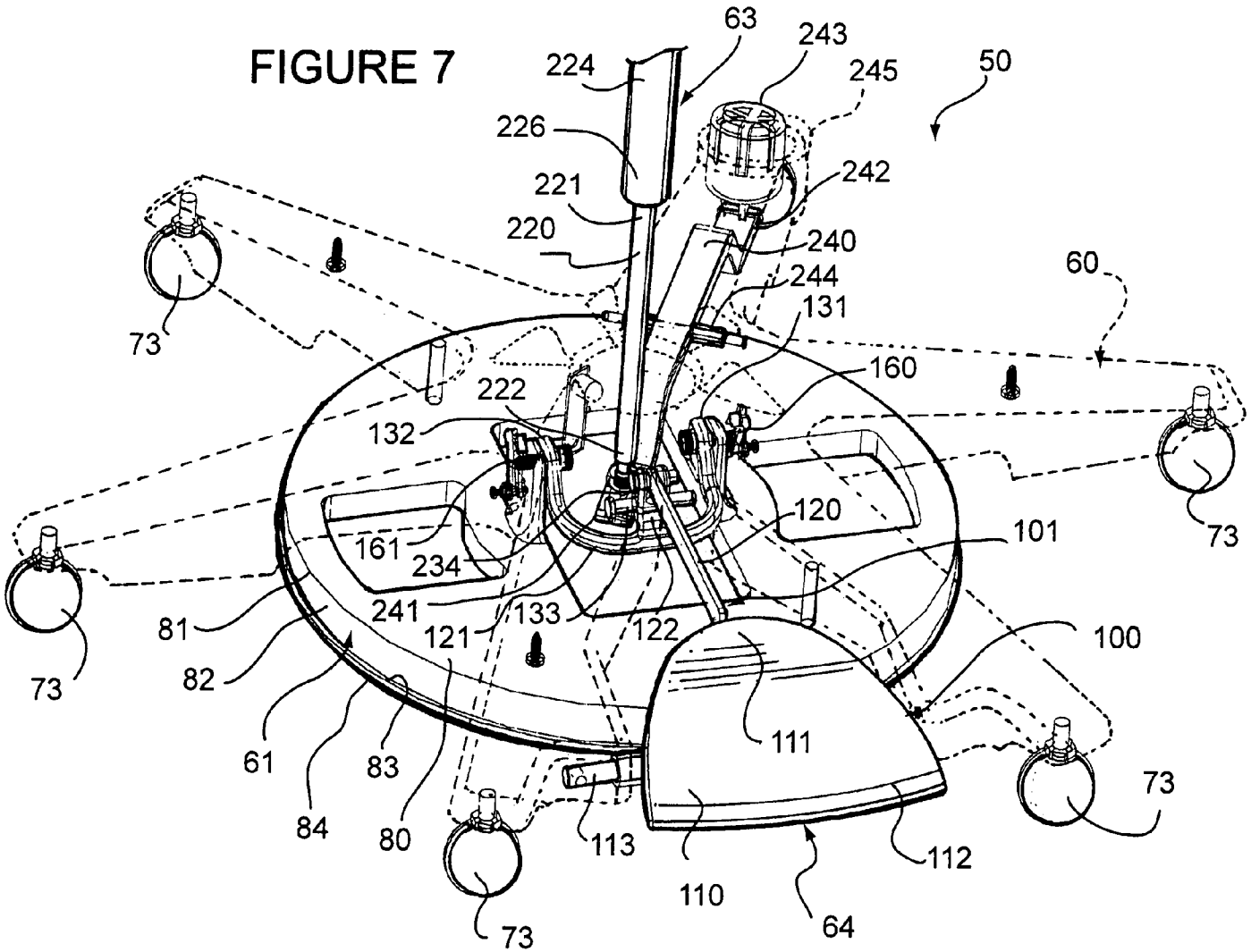
FIG. 7 a partially schematic perspective view of the base of the high chair of FIG. 1 illustrating a wheeled frame depicted in phantom outline superimposed over an arresting fixture, a mechanism for moving the arresting fixture between stored and arresting positions, and a cylinder assembly, the mechanism for moving the arresting fixture between stored and arresting positions including a linkage assembly coupled between a lever, the frame, and the arresting fixture, whereby pivotal movement of the lever urges corresponding reciprocal movement of the arresting fixture between stored and arresting positions.
Figure 8:
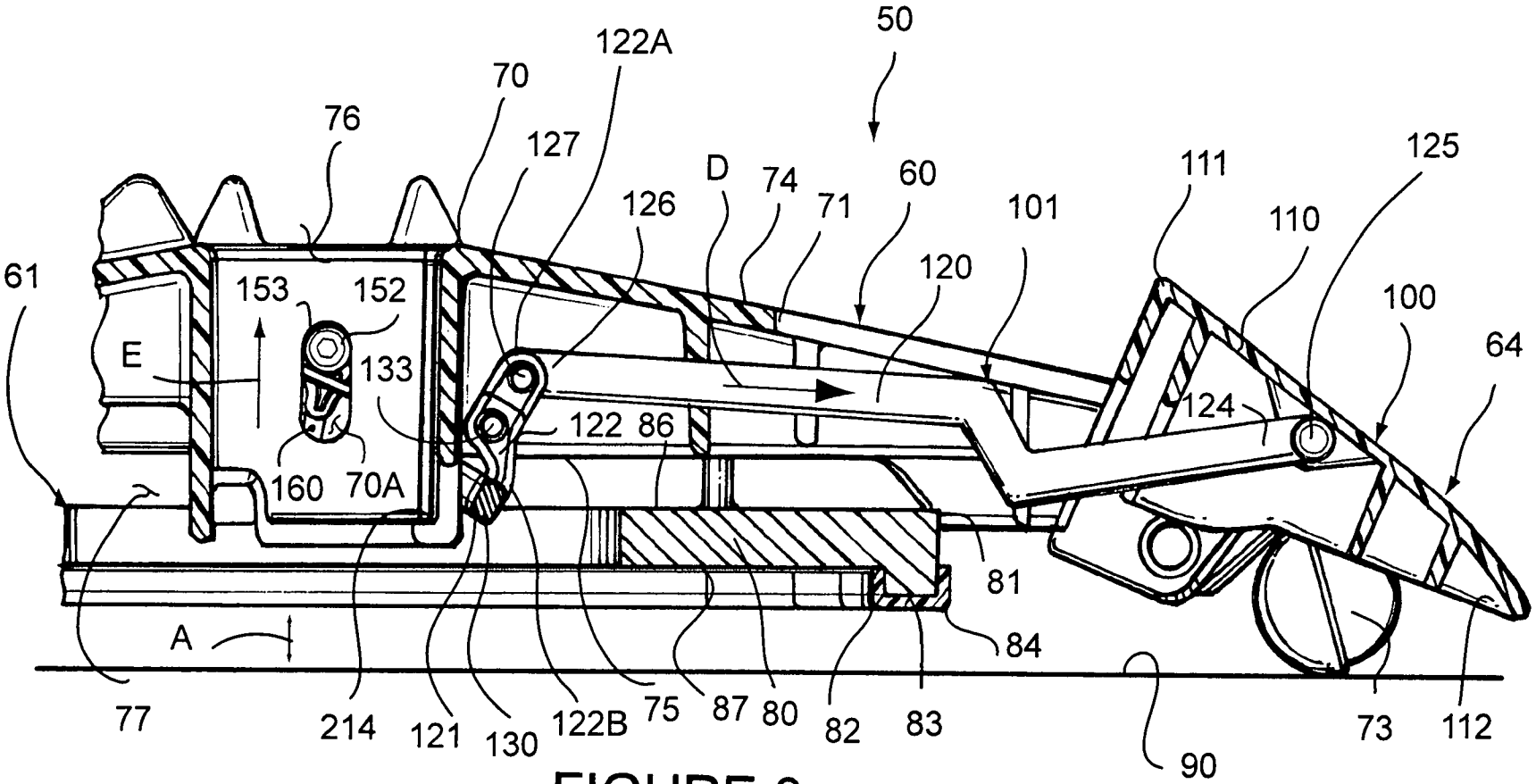
FIG. 8 is a fragmented vertical sectional of the frame, arresting fixture, and mechanism of FIG. 7, in which the lever is shown in a lowered position orienting the linkage assembly in a raised position thereby disposing the arresting fixture in a raised position.
Figure 9:
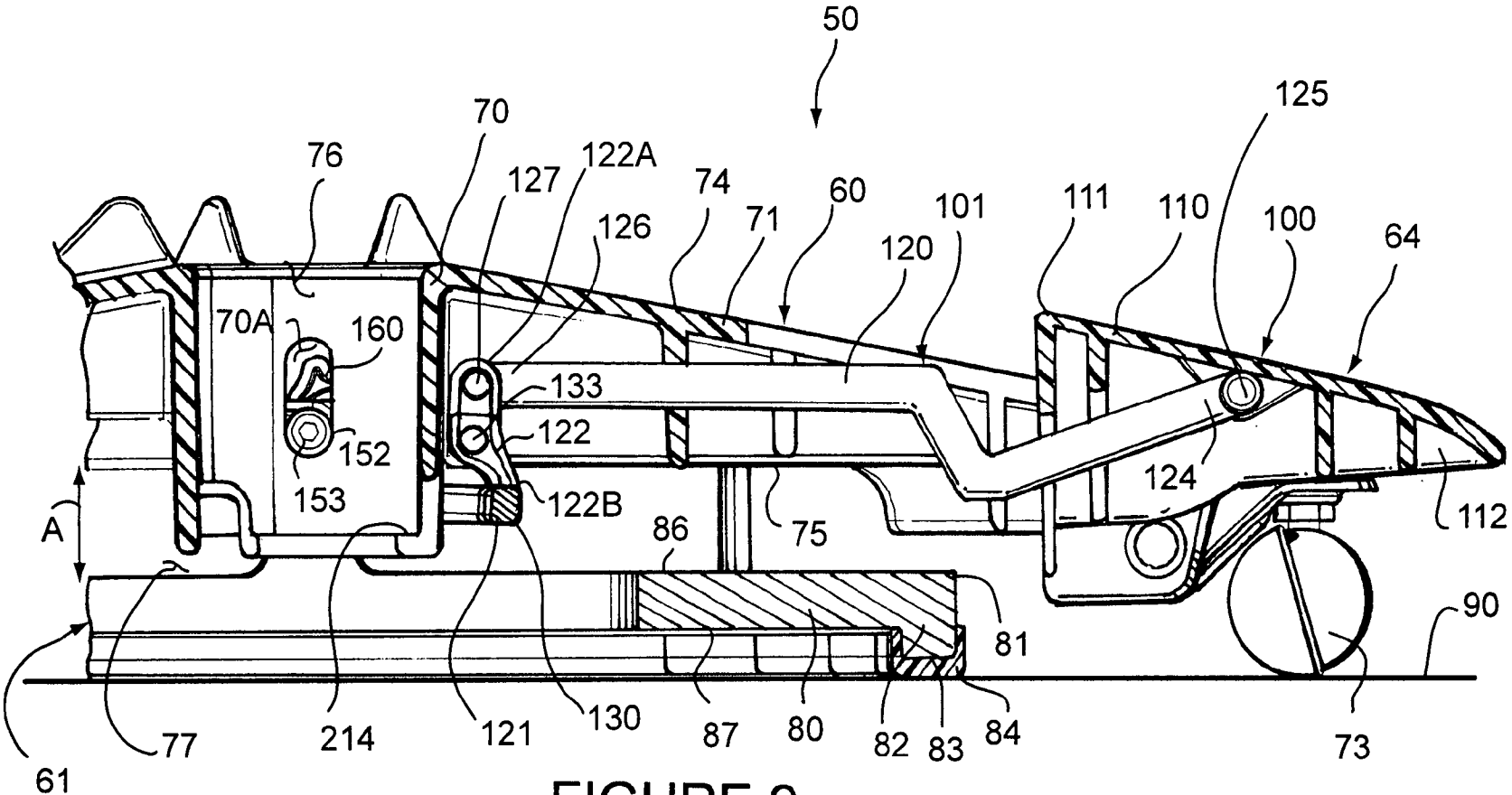
FIG. 9 is a view very similar to the view of FIG. 8, in which the lever is shown in a raised position orienting the linkage assembly in a lowered position thereby disposing the arresting fixture in a lowered or arresting position.

Looking to FIG. 7, arresting fixture 61 is a broad, heavy, circular plate 80 having an outer parametric edge 81 defining a periphery of arresting fixture 61. The periphery of arresting fixture 61 defines a footprint of arresting fixture 61. Plate 80 is preferably formed of cast steel or other heavy material, and weighs approximately 15–25 pounds, although it can weigh less than 15 pounds or more than 25 pounds if desired. A parametric sidewall 82 depends downwardly from parametric edge 81 terminating with a parametric lower end 83 as shown in FIGS. 8 and 9. A resilient, elastomeric, parametric boot 84 is applied to parametric lower end 83 of arresting fixture 61. As best seen in FIG. 5, the footprint defined by the periphery of frame 60 is larger than the footprint defined by the periphery arresting fixture 61. For the purpose of orientation and reference, plate 80 has an upper face 86 and an opposing lower face 87, which are referenced in FIGS. 4, 8, and 9.

According to the principle of the invention, arresting fixture 61 is located in receiving area 77 underneath bottom of frame 60 as best seen in FIGS. 4, 8, and 9. Mechanism 64 is coupled between frame 60 and arresting fixture 61. Arresting fixture 61 is centrally located in receiving area 77, upper face 86 of arresting fixture 61 faces bottom 75 of frame 60, and lower face 87 of arresting fixture 61 faces away from bottom 75 of frame 60 toward a surface 90 onto which wheels 74 of frame 60 are set. FIG. 5 is a bottom plan view of high chair 50 illustrating frame 60 and arresting fixture 61. As seen in FIG. 5, the footprint of arresting fixture 61 is entirely within the footprint of frame 60 and is encircled by wheels 73.

According to the invention, arresting fixture 61 is mounted to frame 60, with mechanism 64, for movement in reciprocal directions relative to bottom 75 of frame 60 as indicated by the double arrowed line A in FIGS. 4, 8, and 9 between a raised/stored position toward bottom 75 of frame 60 as depicted in FIG. 8, and a lowered/arresting position away from bottom 75 of frame 60 for engagement with surface 90 as shown in FIGS. 2, 4, and 9 for arresting frame 60 from wheeled movement over surface 90 essentially securing high chair 50 at a fixed position on surface 90. Accordingly, when arresting fixture 61 is in its arresting position engaged against surface 90, a child sitting in seat assembly 51 may be safely fed without risk of high chair 50 moving about. In the lowered position of arresting fixture 61, boot 84 is brought into engagement with surface 90 onto which wheels 73 are set. This engagement of arresting fixture 61 against surface 90 together with the weight of arresting fixture 61 arrests frame 60 from wheeled movement. The elastomeric nature of boot 84 grips surface 90. When arresting fixture 61 is moved into its raised/stored, arresting fixture 61 is disengaged from surface 90 permitting wheeled movement of frame 60 over surface 90.

Mechanism 64 is used to move arresting fixture 61 between its stored and arresting positions. Referring to FIG. 7, mechanism 64 consists of a lever 100 mounted to frame 60 for pivotal movement, and a linkage assembly 101 coupled between lever 100, frame 60, and arresting fixture 61, whereby pivotal movement of lever 100 urges corresponding reciprocal movement of the arresting 61 between its stored/raised position as shown in FIG. 8, and its arresting/lowered position as shown in FIGS. 4 and 8. Looking also to FIGS. 5, 6, and 12, lever 100 consists of a pedal 110 having an inner end 111 and an opposing outer end 112. An axle 113 is attached to frame 60 and extends between a pair of opposed legs 71 between hub 70 and outer ends 72 of the pair of opposed legs 71. Pedal 110 is positioned between the pair of opposed legs 71 to which axle 113 is attached. Inner end 111 of pedal 110 is attached to axle 113 extending between the pair of legs 71, and outer end 112 is directed outwardly toward the periphery of frame 60. Pedal 110 is a lever that pivots at axle 113 between a first/raised position as shown in FIG. 9, and a second/lowered position as shown in FIG. 8. Axle 113 defines a fulcrum about which pedal 110 pivots.

Figure 12:
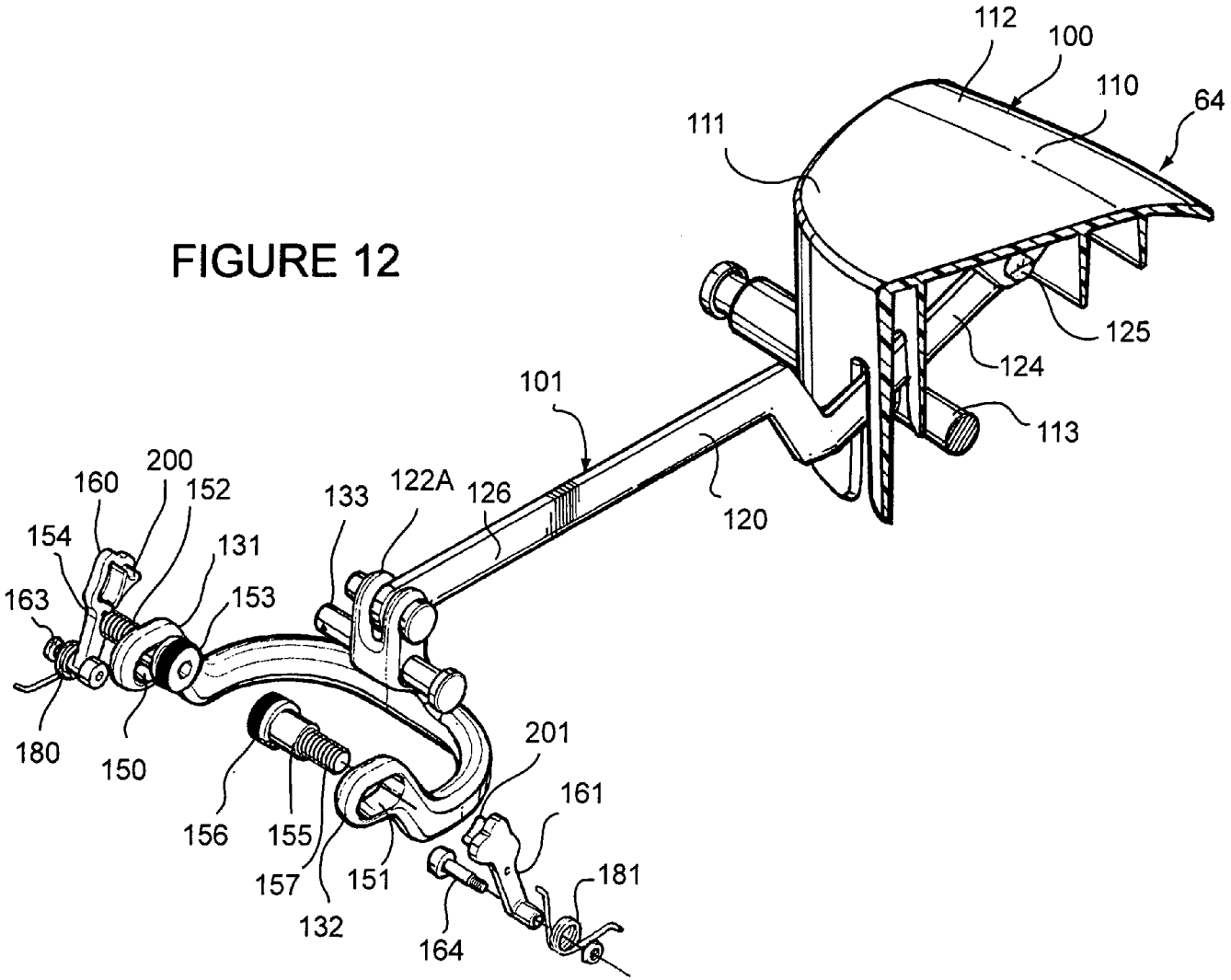
FIG. 12 is a partially exploded perspective view of the mechanism of FIG. 8 including the linkage assembly and the lever for operating the linkage assembly.

Linkage assembly 101 consists of a drawbar 120, a yoke 121, and a rocker arm 122 having an upper end 122A and an opposing lower end 122A affixed to yoke 121. Referring to FIGS. 8, 9, and 12, drawbar 120 is elongate and includes an outer end 124 pivotally attached to pedal 110 at a generally intermediate position between inner and outer ends 111 and 112 with a pivot pin 125, and an opposing inner end 126, which extends inwardly away from the periphery of frame 60 toward hub 70 as shown in FIGS. 8 and 9. With additional reference to FIG. 13, inner end 126 is pivotally attached to upper end 122A of rocker arm 122 with a pivot pin 127. Lower end 122A of rocker arm 122 is affixed to rear end 130 of yoke 121, which is located near hub 70 as shown in FIGS. 8 and 9. Yoke 121 is U-shaped and extends forwardly of rocker arm 122 to opposed, spaced-apart free ends 131 and 132 located on either side of hub 70 as shown in FIG. 10. Opposed, vertical, elongate slots 70A and 70B are formed on either side of hub 70. Free end 131 of yoke 121 is located alongside slot 70A, and free end 132 of yoke 121 is located alongside slot 70B. Rocker arm 122 is pivotally attached to frame 60 between its upper and lower ends 122A and 122B with a pivot pin 133, which defines the fulcrum of rocker arm 122 about which rocker arm 122 pivots.

Looking to FIG. 10, free end 131 is situated between hub 70 and a bracket 140 (shown also in FIG. 11) depending downwardly from bottom 75 of frame 60 toward upper face 86 of arresting fixture 61, and free end 132 is situated between hub 70 and a bracket 141 depending downwardly from bottom 75 of frame 60 toward upper face 86 of arresting fixture 61. A tongue 144 (seen also in FIG. 11) extends upwardly from upper face 86 of arresting fixture 61 and is situated between free end 131 of yoke 121 and bracket 140, and a tongue 145 extends upwardly from upper face 86 of arresting fixture 61 and is situated between free end 132 of yoke and bracket 141.

Figures 13, 14A, 14B, 14C:
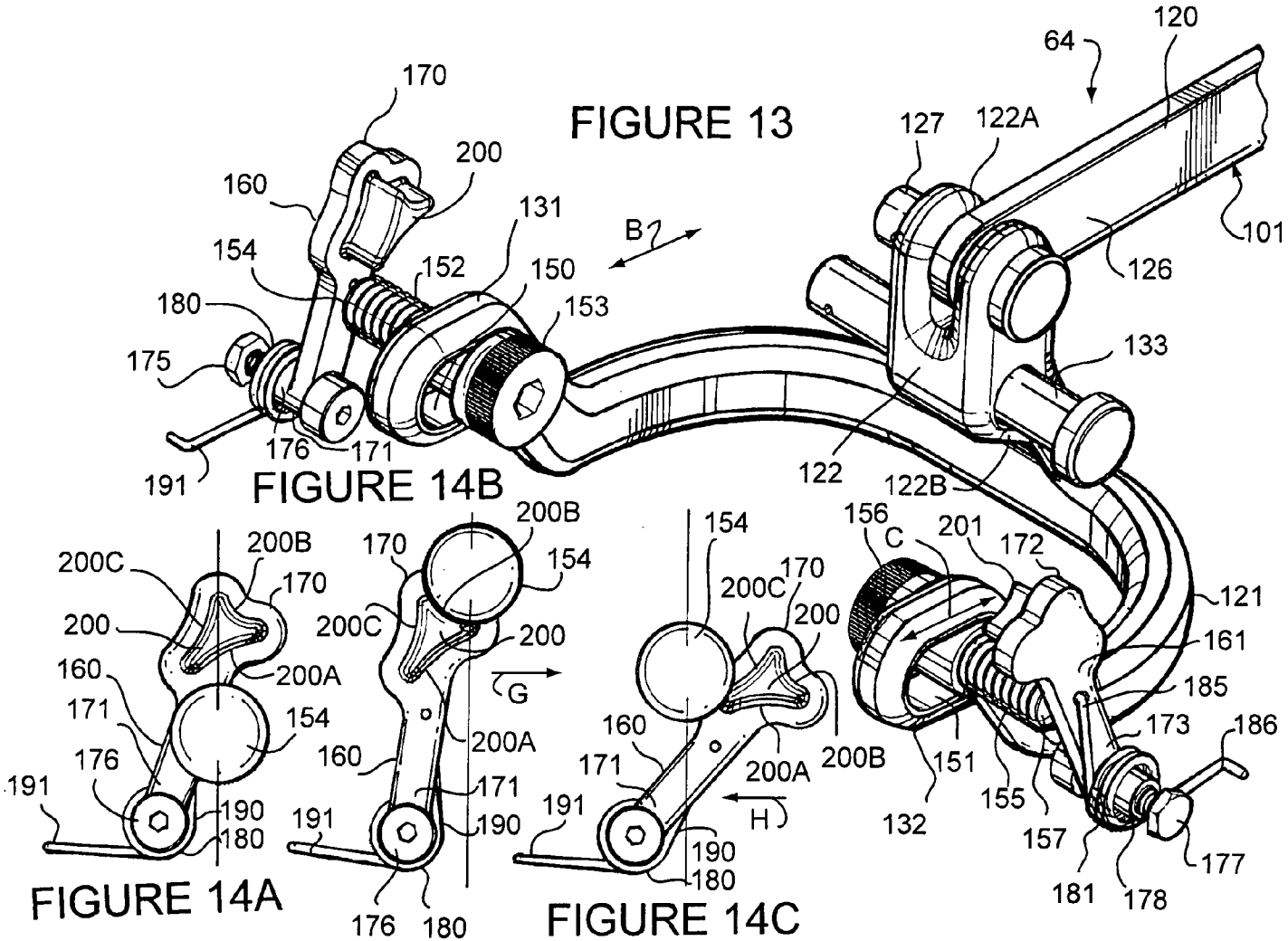
FIG. 13 is an enlarged, fragmented perspective view of the linkage assembly of FIG. 12.
FIGS. 14A–14C show a sequence of operation of a pawl associated with the linkage assembly of FIG. 13.

Free ends 131 and 132 of yoke 121 are formed with elongate apertures 150 and 151, respectively, extending therethrough, as shown in FIGS. 12 and 13. A bolt 152 extends through aperture 150 from the inner side of free end 131 and has a threaded end 154 threadably secured through tongue 144 located on the outer side of free end 131 as seen in FIG. 10. Bolt 152 has an enlarged head 153, which is situated along the inner side of free end 131, and which rides in 70A formed in hub 70 as shown in FIG. 10. A bolt 155 extends through aperture 151 from the inner side of free end 132 and has a threaded end 157 threadably secured through tongue 145 located on the outer side of free end 132 as shown in FIG. 10. Bolt 155 has an enlarged head 156, which is situated along the inner side of free end 132, and which rides in slot 70B formed in hub 70 as shown in FIG. 10. Bolts 152 and 155 secure free ends 131 and 132 of yoke 121 to arresting fixture 61 thereby suspending arresting fixture 61 from free ends 131 and 132. The elongated configuration of apertures 150 and 151 allow free ends 131 and 132 to migrate relative to bolts 152 and 155 in reciprocal direction indicated by the double arrowed lines B and C, respectively, in FIG. 13.

Pedal 110 is operated by foot. Linkage assembly 101 is movable between a first position corresponding to the raised position of pedal 110 and a second position corresponding to the lowered position of pedal 110. In the raised position of pedal 110 as shown in FIG. 9, linkage assembly 101 places arresting fixture 61 in its arresting position, in which drawbar 120 is disposed inwardly relative to hub 70 thereby disposing yoke 121 in a lowered position. To move arresting fixture 61 from its arresting position to its stored position, pedal 110 is depressed, such as with a foot, pivoting pedal 110 at axle from its raised position to its lowered position as shown in FIG. 8. As pedal 110 is pivoted from its raised position as shown in FIG. 9 to its lowered position as shown in FIG. 8, pedal 110 draws drawbar 120 outwardly in the direction indicated by the arrowed line D in FIG. 8 away from hub 70. As drawbar 120 is drawn outwardly, it in turn concurrently pulls upper end 122A of rocker arm 122 outwardly in the direction indicated by the arrowed line D pivoting yoke 121 about pivot pin 133 thereby displacing yoke 121 urging free ends 131 and 132 upwardly toward frame 60 in the direction indicated by the arrowed line E in FIG. 8 lifting arresting fixture 61 out of its arresting position away from surface 90 into its stored position toward bottom 75 of frame 60. Reversing this operation moves arresting fixture 61 from its stored position back to its arresting position. Accordingly, arresting fixture 61 is easily moved back and forth between its arresting and stored position by repeated pivotal movement of pedal 110 between its raised and lowered positions. Any suitable linkage assembly or mechanism coupled between pedal 110, frame 60, and arresting fixture 61 for moving arresting fixture 61 between its arresting and stored positions in response to movement of pedal 100 can be used without departing from the invention.

High chair 50 incorporates retention mechanism for maintaining arresting fixture 61 in its stored position, which will now be described. Looking back to FIG. 10, high chair 50 incorporates pawls 160 and 161. Pawl 160 is situated between bracket 140 and tongue 144, and pawl 161 is situated between bracket 141 and tongue 145. Pawl 160 is carried by bracket 140 of frame 60, pawl 161 is carried by bracket 141 of frame 60, and both are used to retain arresting fixture 61 in its stored position and constitute part of the retention mechanism of high chair 50.

Pawls 160 and 161 operate identically and have the same structure. Pawl 160 has opposing upper and lower ends 170 and 171, and pawl 161 has opposing upper and lower ends 172 and 173. A threaded bolt 175 extends through bracket 140 and threadably engages a sleeve 176 formed in lower end 171 of pawl 160, and a corresponding threaded bolt 177 extends through bracket 141 and threadably engages a sleeve 178 formed in lower end 173 of pawl 161. Pawl 160 is free to pivot at sleeve 176 relative to threaded bolt 175, and pawl 161 is free to pivot at sleeve 178 relative to threaded bolt 177. A compression spring 180 encircles sleeve 176 and is situated between pawl 160 and bracket 140, and a corresponding compression spring 181 encircles sleeve 178 and is situated between pawl 161 and bracket 141.

Spring 181 is a wire formed into coils encircling sleeve 178. The outermost coils of spring 181 lead to tag ends 185 and 186, respectively. Tag end 185 is secured to pawl 161, and tag end 186 is secured to bracket 141. Spring 181 is fashioned of spring steel, a nickel-based spring alloy, or other material or combination of materials having a substantially constant moduli of elasticity as is typical with tension springs.

Like compression spring 181, compression spring 180 is a wire formed into coils encircling sleeve 176. The outermost coils of spring 180 lead to tag ends 190 and 191, respectively. Tag end 190 is shown only in FIGS. 14A–14C. Tag end 190 of spring 180 is secured to pawl 160, and tag end 191 is secured to bracket 140. Spring 180 is fashioned of spring steel, a nickel-based spring alloy, or other material or combination of materials having a substantially constant moduli of elasticity as is typical with tension springs.

Upper ends 170 and 172 of pawls 160 and 161 are formed with deflectors 200 and 201, respectively. In the arresting position of arresting fixture 61, deflector 200 overlies and confronts threaded end 154 of bolt 152, and deflector 201 overlies and confronts threaded end 157 of bolt 155, which represents the resting positions of pawls 160 and 161. In the resting positions of pawls 160 and 161, springs 180 and 181 are at rest maintaining pawls 160 and 161 in their resting positions. Pawls 160 and 161 operate in conjunction with the movement of arresting fixture 61 between its arresting and stored positions, and together interact with bolts 152 and 157, respectively, functioning to hold arresting fixture 61 in its stored position. Pawls 160 and 161 operate identically to one another as previously explained in conjunction with bolts 152 and 157, respectively, and only the operation of pawl 160 will be discussed with the understanding the ensuing discussion of the operation pawl 160 applies equally to pawl 161. Furthermore, pawls 160 and 161 operate concurrently relative to each other in response to movement of arresting fixture 61 between its arresting and stored positions for holding arresting fixture 61 in its stored position.

FIGS. 14A–14C show the sequence of operation of pawl 160 in conjunction with threaded end 154 of linkage assembly 101 (not referenced in FIGS. 14A–14C), and the relationship of threaded end 154 of bolt 152 in the arresting position of arresting fixture 61 (not shown in FIGS. 14A–14C). In the arresting position of arresting fixture 61, threaded end 154 opposes and underlies deflector 200. When arresting fixture 61 is moved with mechanism 64 (not shown in FIGS. 41A–14C) from its arresting position upwardly toward its stored position, threaded end 154 hits underside 200A of deflector 200 overcoming the bias applied by spring 180 winding spring 180 and deflecting upper end 171 of pawl 160 out of the upward path of movement of threaded end 154 in the direction indicated by the arrowed line H in FIG. 14B. After threaded end 154 clears underside 200A, the bias supplied by spring 180 causes pawl 160 to snap in the direction indicated by arrowed line G in FIGS. 13 and 14B setting threaded end 154 into a topside seat 200B formed in the upper side of deflector 200 thereby holding arresting fixture 61 in its raised position, in accordance with the principle of the invention.

To move arresting fixture 61 back to its arresting position from its stored position, arresting fixture 61 is raised with mechanism 64 moving threaded end 154 upwardly away from topside seat 200B until threaded end 154 clears top side seat 200B, at which point the bias provided by spring 180 snaps upper end 170 of pawl 160 in the direction indicated by arrowed line G in FIG. 14B registering threaded end 154 with backside 200C of deflector 200. At this point, mechanism 64 is used to move arresting fixture 61 back to its arresting position. As arresting fixture 61 moves downwardly toward its arresting position, threaded end 154 hits backside 200C of deflector 200 overcoming the bias applied by spring 180 unwinding spring 180 deflecting upper end 171 of pawl 160 out of the downward path of movement of threaded end 154 in the direction indicated by arrowed line G allowing arresting fixture 61 to move unencumbered to its arresting position. After threaded end 154 clears backside 200C, spring 180 causes pawl 160 to snap in the direction indicated by arrowed line H in FIG. 14C setting pawl 160 back to its original resting position in FIG. 14A. When arresting fixture 61 then assumes is arresting position, threaded end 154 opposes and underlies deflector 200 as shown in FIG. 14A, in which spring 180 at rest maintains pawl 160 in its resting position.

The retention mechanism herein described is useful for holding arresting fixture 61 in its stored position without having to maintain arresting fixture 61 in its stored position by holding pedal 110 in its lowered position. When arresting fixture 61 is held by the retention mechanism in its stored position, high chair 50 may be wheeled about as needed. Pawls 160 and 161, which are each elements carried by frame 60, operate in conjunction with the movement of arresting fixture 61 between its arresting and stored positions, and together interact with bolts 152 and 157, respectively, which are each complemental elements carried by linkage assembly 101, functioning to hold arresting fixture 61 in its stored position. Although retention mechanism of high chair 50 incorporates two elements and two corresponding complemental elements, less or more corresponding pairs of elements and complemental elements can be used, if desired. Furthermore, although in the instant embodiment bolts 152 and 157, the complemental elements of the retention mechanism, are carried by linkage assembly 101, they can be carried by arresting fixture 61, if desired, without departing from the invention.

Referring back to FIG. 3, base 52 further includes a telescoping support 210 having a lower end 211 set in central opening 76 encircled and defined by hub 70 as seen in FIG. 4, and an opposing upper end 212 formed with an annular flange 213 onto which the underside of seat 53 is placed and secured, preferably with screws, rivets, or the like. A cap 216 encircles telescoping support 210, is presented up against the underside of seat 53, and is affixed in place to flange 213 with screws, rivets, or the like, enclosing flange 213 thereby providing a pleasing, aesthetic appearance as shown in best in FIG. 2. Lower end 211 is received and supported against an inwardly directed annular flange 214 (FIG. 11) formed in hub 70, which extends into central opening 76. Hub 70 encircles and braces lower end 211. Lower end 211 is affixed to hub 70 with one or more fasteners, such as one or more screws, nut-and-bolt assemblies, or the like. Lower end 211 can be keyed to hub 70, if desired, or threadably secured to hub 70 by providing lower end 211 and hub 70 with mutual inwardly and outward threads.

Telescoping support 210 is fashioned of aluminum, steel, hard plastic, or other substantially rigid material or combination of materials, and is hollow. Cylinder assembly 63 is set in telescoping support 210 and is coupled between seat 53 and frame 60, and consists of a rod 220, having opposed upper and lower ends 221 and 222, and a cylinder 224, having opposed upper and lower ends 225 and 226. Upper end 221 of rod 220 is partially received into lower end 226 of cylinder 224. Upper end 212 of telescoping support 210 is fashioned with an opening 230, and upper end 225 of cylinder 224 is furnished with a key 231. A pin 232 passes concurrently through opening 230 and key 231 detachably securing upper end 225 of cylinder 224 to upper end 212 of telescoping support 210. Upper end 225 can, if desired, be coupled directly to seat 53.

Cylinder assembly 63 is exemplary of a conventional and well-known pneumatic cylinder assembly. Lower end 222 of rod 220 is fashioned with a switch 234, which is movable between an extended or OFF position securing cylinder assembly 63 and a depressed or ON position engaging cylinder assembly 63. When switch 234 is in its OFF position placing cylinder assembly 63 in its secured position, rod 220 and cylinder 224 are rigid and disposed at fixed length. When switch 234 is in its ON position placing cylinder assembly in an engaged position, rod 220 is free to reciprocate relative to cylinder 224 between a retracted position in cylinder 224 corresponding to a shortened or retracted condition of cylinder assembly 63 and an extended position away from cylinder 224 corresponding to an extended or lengthened condition of cylinder assembly 63. Because upper end 225 of cylinder 224 is coupled to upper end 212 of telescoping support 210, cylinder assembly 63 and telescoping support 210 reciprocate concurrently thereby allowing seat 53 secured to upper end 213 of telescoping support 210 to be easily moved in reciprocal directions as indicated by the double arrowed line I in FIG. 2 between lowered and raised positions relative to frame 60 of base 52.

Figure 6:
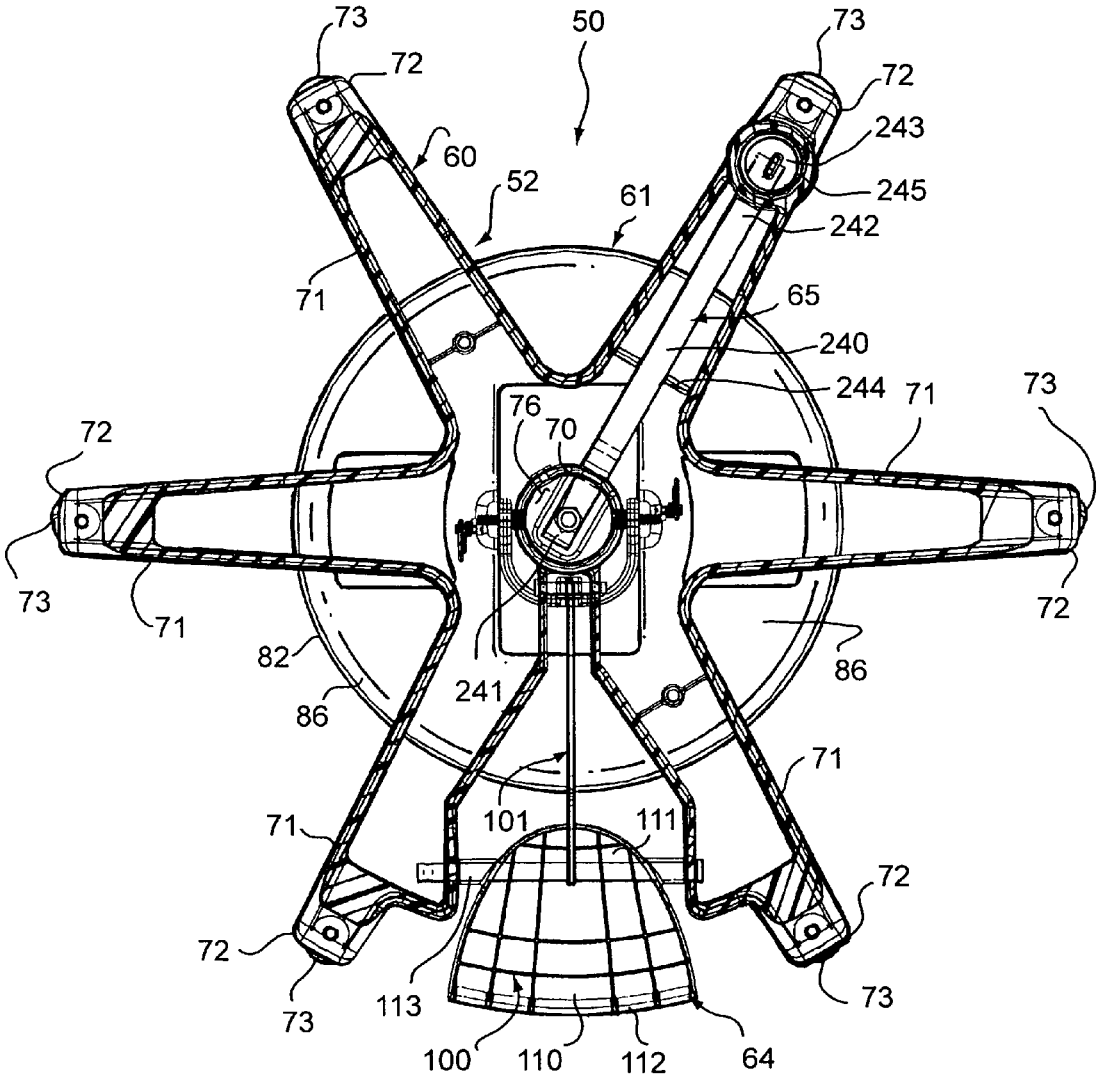
FIG. 6 is a sectional view taken along line 6—6 of FIG. 1.

Actuating assembly 65 is used to operate cylinder assembly 63, namely, to move switch 234 between its OFF and ON positions. Referring to FIGS. 6 and 7, actuating assembly 65 includes a pedal 243 operatively coupled to switch 234, whereby movement of pedal 243 urges corresponding movement of switch 234 between its first and second positions. Preferably, a lever is the mechanism interacting between pedal 243 and switch 234, which consists of an elongate bar 240 having opposed inner and outer ends 241 and 242 and pedal 243 attached to outer end 242. Bar 240 extends along one of legs 71 and is coupled thereto for pivotal movement with a pivot pin 244. Inner end 241 underlies switch 234 as seen in FIGS. 4, 7, and 10. Pedal 243 is mounted for pivotal movement to outer end 242 of bar 240, and extends upwardly through a socket 245 formed in leg 71 adjacent to its outer end 72 as seen in FIGS. 5–7. Pin 240 defines the fulcrum about which bar 240 pivots.

Bar 240 pivots about pin 244 between a first position corresponding to a raised position of outer end 212 and pedal 213 and a lower position of outer end 242 of bar 240 away from switch 234 thereby leaving switch 234 in its OFF position securing cylinder assembly 63, and a second position corresponding to a lowered position of outer end 212 and pedal 213 and a raised position of outer end 242 of bar 240 toward switch 234 engaging and depressing it into its depressed position engaging cylinder assembly 63 permitting reciprocal adjustment of seat 53. Bar 240 is situated in its fist position at rest thereby placing cylinder assembly 63 in its secured position.

Pedal 243 is operated by foot. To place cylinder assembly 63 in its engaged position, bar 240 is moved from its first position to its second position causing outer end 242 to depress switch 234 by depressing pedal 243 by foot. To move cylinder assembly 63 back to its secured position from its engaged position after adjusting seat 53 to a selected height, pedal 243 is released causing bar 240 to assume its second resting position releasing switch 234 thereby moving it to its OFF position securing cylinder assembly 63. Although a lever is the mechanism interacting between pedal 243 and switch 234 thereby operatively coupling pedal 243 to switch 234, other mechanisms capable of operatively coupling pedal 243 to switch 234 can be used without departing from the invention for urging corresponding movement of switch 234 between its first and second positions in response to movement of pedal 243 including, for instance, any suitable linkage assembly, a gear assembly, a cam, etc.

Looking to FIG. 3, base cover 62 is essentially a dome, which is formed with a pedal opening 250, a pedal notch 251, and a central opening 252 extending through a central raised peak 253. Base cover 62 is formed of plastic or other similar material, and fits over frame 60 covering it. Base cover 62 is secured to frame 60 with screws, rivets, or the like. As seen in FIG. 1, pedal 243 extends through pedal opening 250 thereby allowing it to be accessed and depressed by foot, and pedal 110 is situated in pedal notch 251 thereby allowing it to be accessed and depressed by foot. Telescoping support 210 and cylinder assembly 63 enclosed therein extend upwardly through central opening 252 formed in peak 253 to seat 53 positioned thereabove.

Figure 15:
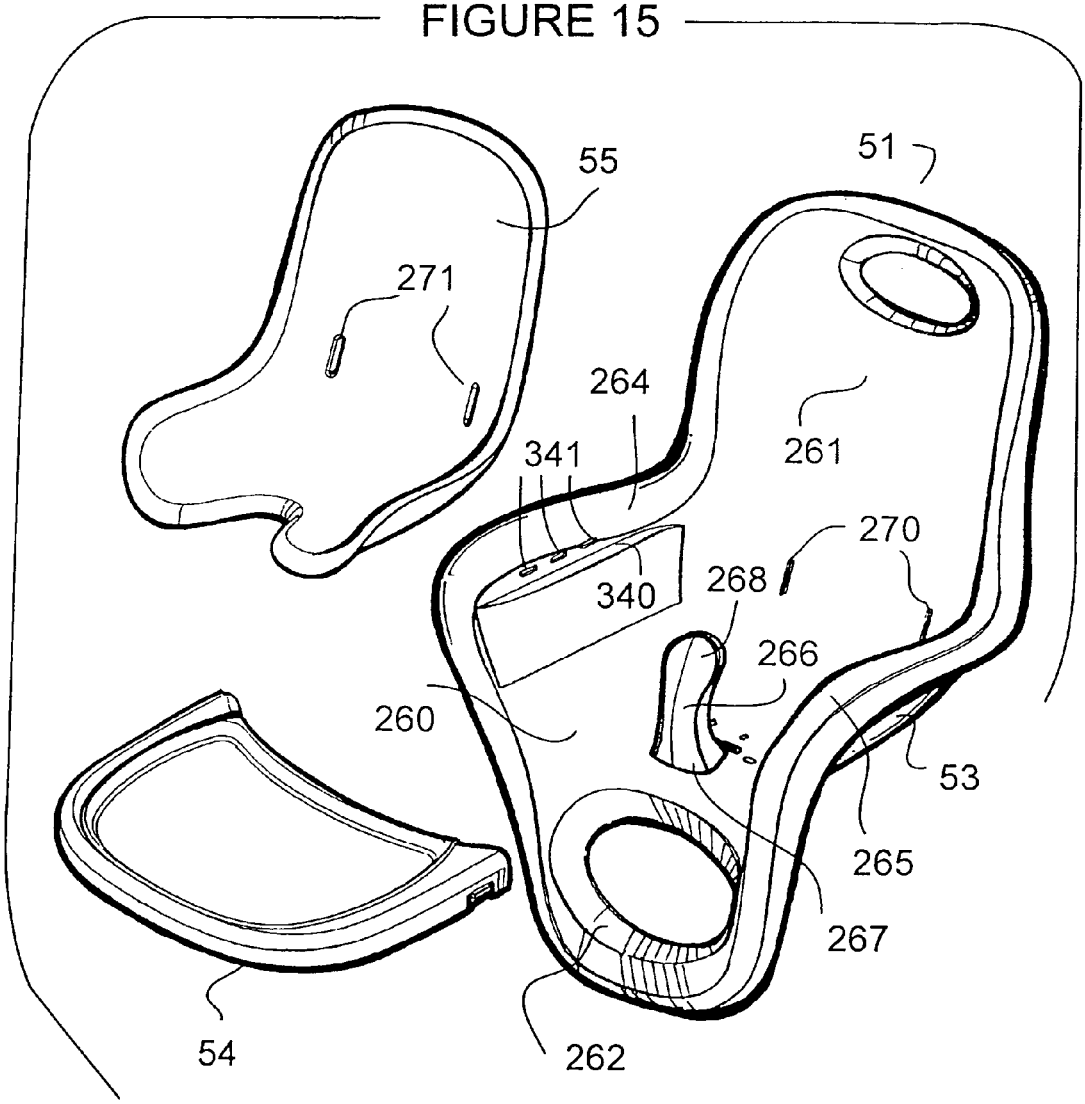
FIG. 15 is an exploded perspective view of the seat assembly of the highchair of FIG. 1, the seat assembly including a seat, a seat pad, and a tray.

Looking now to FIG. 15, seat 53 includes a seat bottom 260, a seat back 261 extending upwardly from the back of seat bottom 260, a foot rest 262 extending downwardly from the front of seat bottom 260, elevated arms 264 and 265 extending between seat bottom 260 and seat back 261 to support tray 54, and a crotch post 266 adjacent to the front of seat bottom 260 positioned between arms 264 and 265. Crotch post 266 has a lower end 267 rigidly affixed to seat bottom 260 and projects upwardly therefrom to an opposing free upper end 268. Seat pad 55 is positioned on seat 53 against seat bottom 260, rearwardly of crotch post 266, and seat back 261 onto which a toddler is to sit, whereby the child's legs are each positioned on either side of crotch post 266 and crotch post 266 functions to prevent the child from slipping off the front end of seat bottom 260. Openings 27 formed in seat back 261 and corresponding openings 271 formed in seat pad 55 are provided for receiving straps (not shown) used to strap a child in seat 53 when seated therein.

Figure 16:
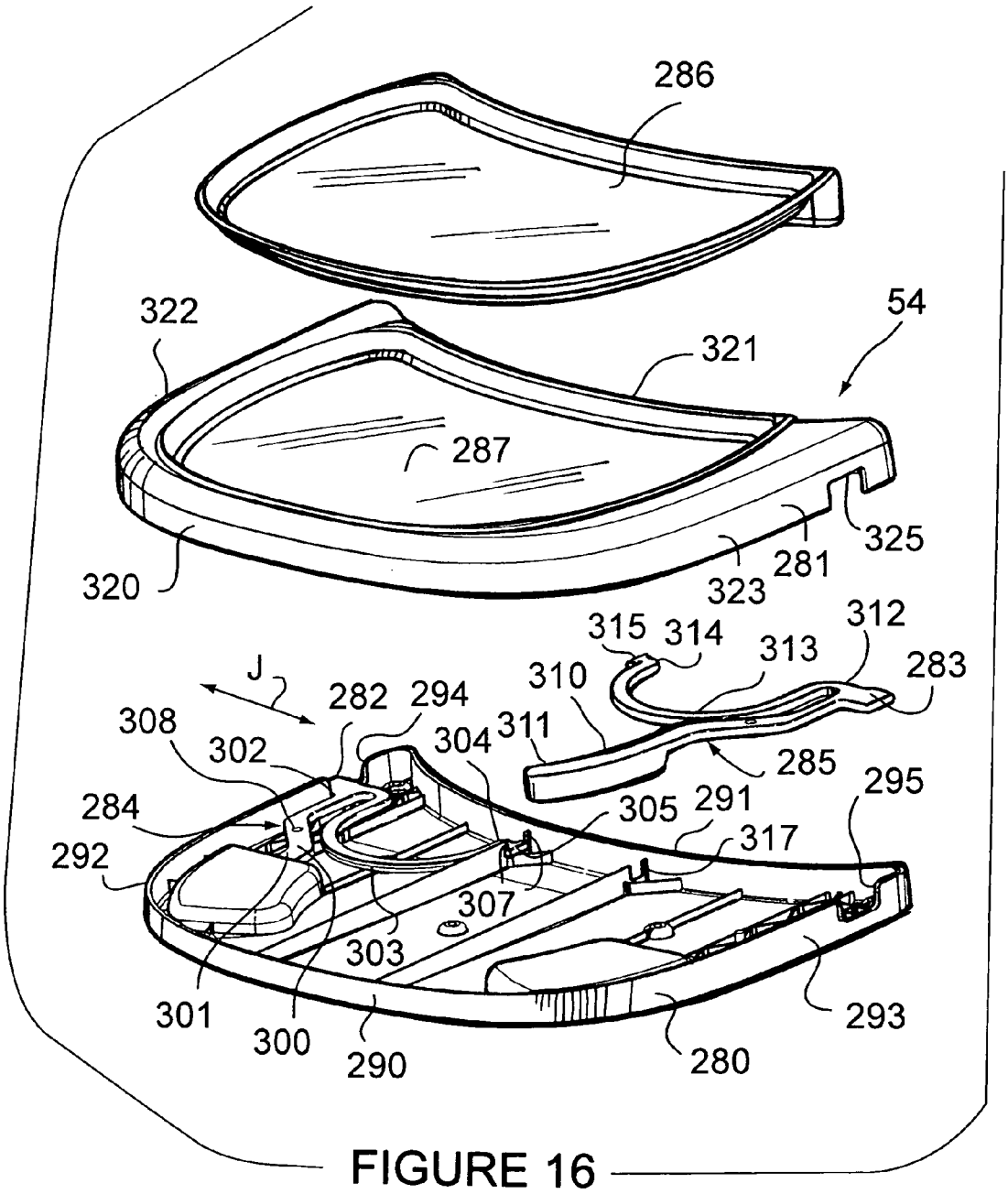
FIG. 16 is a partially exploded perspective the tray of FIG. 15 illustrating a plate, a top cover, a bottom cover, and pair of latches, in which one of the latches is shown attached to the bottom cover and the other one of the latches is shown detached from the bottom cover.

Tray 54 is mounted to arms 264 and 265 of seat 53 as seen in FIG. 1 and is configured to slide relative to seat 53. Referring to FIG. 16, tray 54 is an assembly consisting of a bottom 280, an opposed top 281, keys 282 and 283 carried by corresponding levers 284 and 285, respectively, and a plate 286. Levers 284 and 285 are sandwiched between bottom 280 and top 281. The combination of lever 284 and key 282 is a latch of tray 5.4, as is the combination of lever 285 and key 283. Plate 286 is removably positioned onto top 281 for holding and carrying food, plates, drinking receptacles, eating utensils, and the like, and may be removed when needed for cleaning and then placed back onto top 281 for continued use. The top side of top 281 is formed with a large, broad depression 287, which accepts plate 286.

Figure 17:
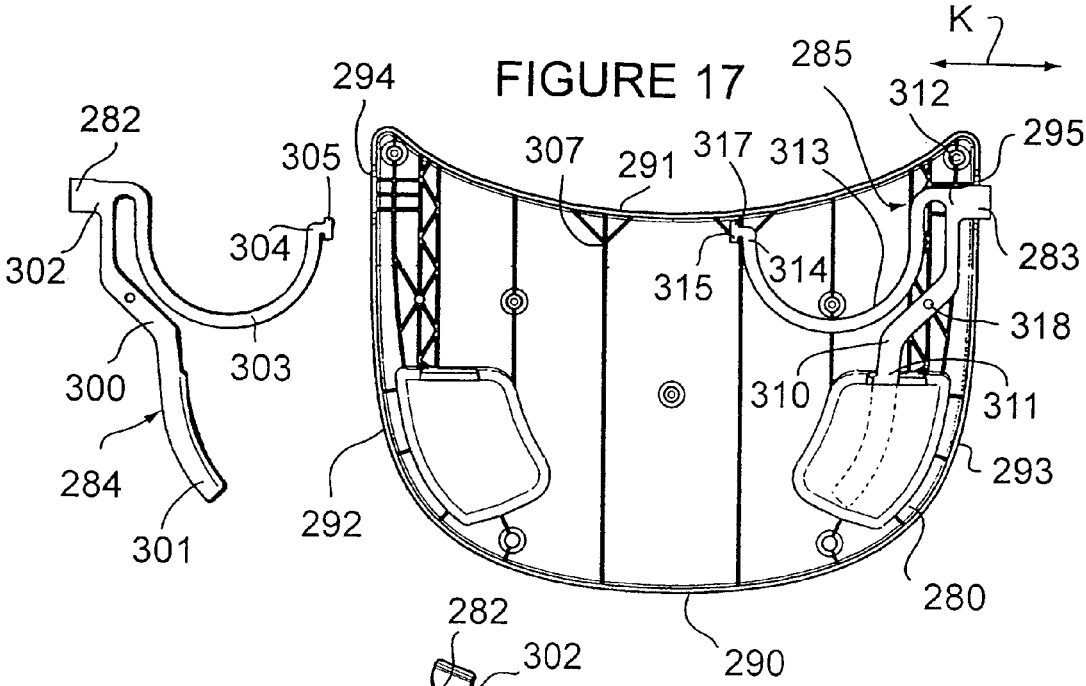
FIG. 17 is a partially exploded bottom plan view of the bottom cover of FIG. 17, in which one of the latches is shown attached to the bottom cover and the other one of the latches is shown detached from the bottom cover.
Figure 18:
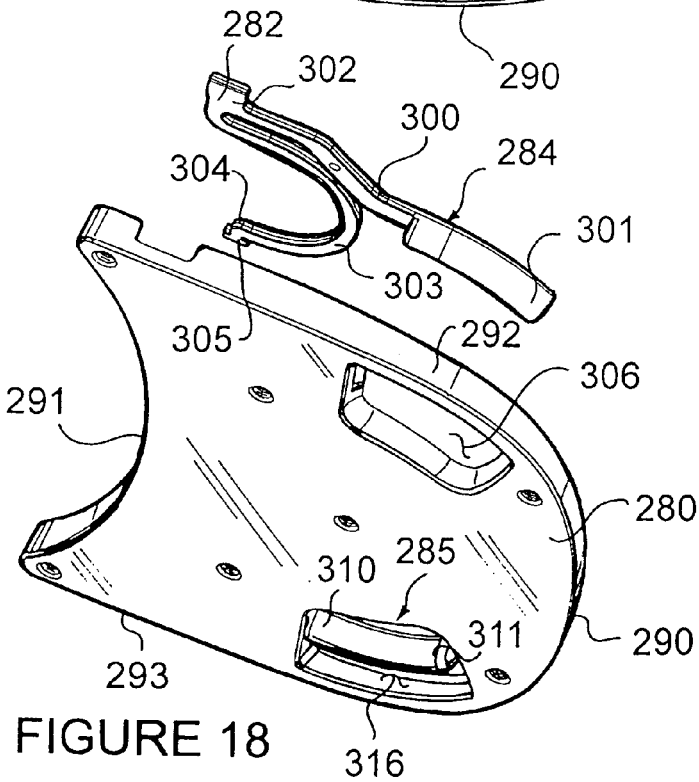
FIG. 18 is a partially exploded perspective of the bottom cover of FIG. 16 illustrating one of the latches shown as it would appear detached therefrom.

Bottom 280 has opposed front and rear ends 290 and 291, and opposed sides 292 and 293 formed with notches 294 and 295, respectively, adjacent to rear end 291. Referring to FIGS. 17 and 18, lever 184 is an integrated body formed of plastic or other similar material and consists of an elongate arm 300 having a handled inner end 301, and an opposing outer end 302. Key 282 projects laterally outwardly from one side of outer end 302, and a U-shaped leg 303 projects laterally outwardly from the opposed side of outer end 302 and terminates with an outer end 304 formed with an enlarged head 305. Lever 285 is the mirror image of lever 284, and as seen in FIGS. 16 and 17 is an integrated body formed of plastic or other similar material and consists of an elongate arm 310 having a handled inner end 311, and an opposing outer end 312. Key 283 projects laterally outwardly from one side of outer end 312, and a U-shaped leg 313 projects laterally outwardly from the opposed side of outer end 312 and terminates with an outer end 314 formed with an enlarged head 315.

Lever 284 is carried by bottom 280 adjacent to side 292, in which key 282 extends outwardly through notch 294 away from side 292 of bottom 280 a seen in FIG. 16. Arm 300 extends forwardly from adjacent to rear end 291 of bottom 280 to handled outer end 301 toward front end 290, which is exposed and accessed through an opening 306 (FIG. 18) formed in the underside of bottom 280 adjacent to front end 290. Leg 303 extends inwardly away from side 292 toward the center of bottom 280 to head 305, which is retained in a notch 307 formed in bottom 280 adjacent to rear end 291. Arm 300 is mounted to bottom 280 for pivotal movement with a pivot pin 308 at a generally intermediate position between inner and outer ends 301 and 302, whereby pivotal movement of arm 300 about pivot pin 308 urges corresponding reciprocal movement of key 282 in the direction indicated by the double arrowed line J in FIG. 16 between a first or extended position outboard of side 292 through notch 294 and a second or retracted position inboard of side 292 through notch 294. Leg 303 is flexible functions as a spring biasing arm 300 in the first position of key 282. To pivot arm 300 and thereby move key 282 between its first and second positions a user need only take up handled inner end 301 by hand at opening 306 (FIG. 6) and exert an appropriate gripping force to handled inner end 301 sufficient to overcome the bias applied by leg 303.

Lever 285 is carried by bottom 280 adjacent to side 293, in which key 283 extends outwardly through notch 295 away from side 293 of bottom 280 a seen in FIG. 17. Arm 310 extends forwardly from adjacent to rear end 291 of bottom 280 to handled outer end 311 toward front end 290, which is exposed and accessed through an opening 316 (FIG. 18) formed in the underside of bottom 280 adjacent to front end 290. Leg 313 extends inwardly away from side 293 toward the center of bottom 280 to head 315, which is retained in a notch 317 formed in bottom 280 adjacent to rear end 291. Arm 310 is mounted to bottom 280 for pivotal movement with a pivot pin 318 at a generally intermediate position between inner and outer ends 311 and 312, whereby pivotal movement of arm 310 about pivot pin 318 urges corresponding reciprocal movement of key 283 in the direction indicated by the double arrowed line K in FIG. 17 between a first position outboard of side 293 through notch 295 and a second position inboard of side 293 through notch 295. Leg 313 functions as a spring biasing arm 310 in the first position of key 283. To pivot arm 310 and thereby move key 283 between its first and second positions a user need only take up handled inner end 311 by hand at opening 316 (FIG. 6) and exert an appropriate gripping force to handled inner end 311 sufficient to overcome the bias applied by leg 313.

Figures 19, 20:
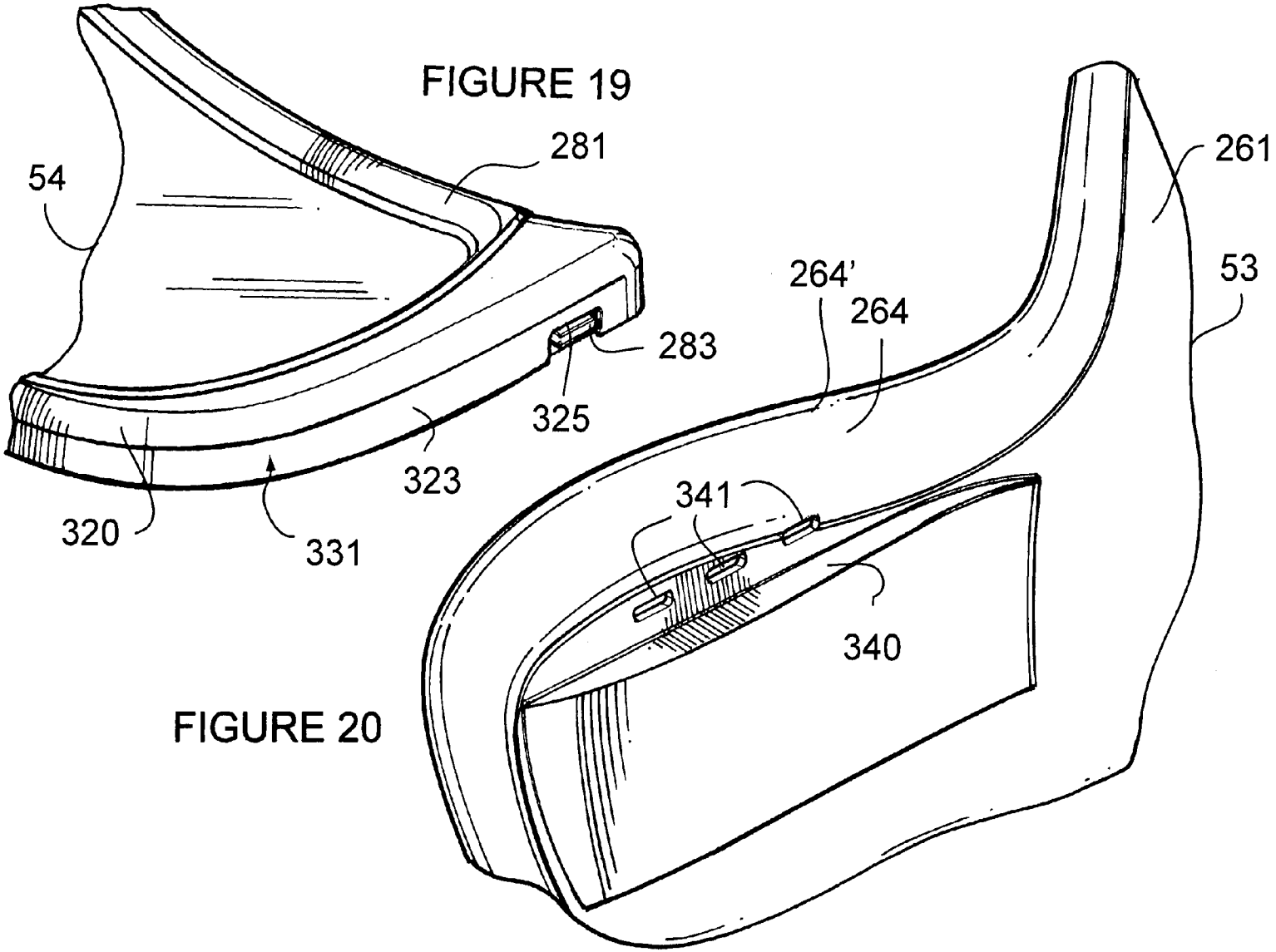
FIG. 19 is an enlarged fragmented perspective view of the tray of FIG. 15 illustrating a tongue of one of the latches of FIG. 16 projecting outwardly through an opening formed in the tray.
FIG. 20 is an enlarged fragmented perspective view of the seat of FIG. 15 illustrating an arm of the seat and a tray seat form in the seat adjacent to the arm.

Referring to FIG. 16, top 281 is set atop bottom 280 enclosing levers 284 and 285 therebetween. Top 281 is generally coextensive relative to bottom 280, and like bottom 280 includes opposing front and rear ends 320 and 321, and opposed sides 322 and 323. A notch 325 is formed in side 323 adjacent to rear end 321, which registers with notch 295 thereby exposing key 283 as seen in FIG. 19 allowing key 283 to move freely between its first and second positions. Although not shown, a corresponding notch is formed in side 322 of top 281 adjacent to rear end 321, which registers with notch 294 thereby exposing key 282 and allowing key 282 to move freely between its first and second positions.

Tray 54 is the assembly of bottom 280, top 281, and plate 286. The front and rear ends of tray 54 are generally represented by the front and rear ends of bottom 280 and top 281. The opposed sides of tray 54 are generally represented by the corresponding sides of bottom 280 and top 281, in which the side of tray 54 corresponding to sides 292 and 322 of bottom and top 280 and 281, respectfully, is generally represented by the reference character 330 in FIG. 1, and the side of tray 54 corresponding to sides 293 and 323 of bottom and top 280 and 281, respectively, is generally represented by the reference character 331 in FIGS. 1 and 19.

Tray 54 is adapted to engage seat 53 and extend between arms 264 and 265 of seat 53 as seen in FIG. 1. The engagement of sides 330 and 31 of tray to seat 53 at arms 264 and 265, respectively, is identical. According, only the discussion of the engagement of side 330 of tray 54 to seat 53 adjacent to arm 264 will be discussed in detail, with the understanding that the ensuing discussion applies equally to the engagement of side 331 of tray 54 to seat 53 adjacent to arm 265.

Looking now to FIG. 20, a tray shelf or seat 340 is formed in the inner side of seat 53 adjacent to and just underlying top side 264' of arm 264 between top side 264' of arm 264 and seat bottom 260, and extends along substantially the entire length of arm 264 from the rear end of arm 264 at seat back 261 to the front end of arm 264 at the front end of seat bottom 260. A plurality of spaced-apart openings 341 are formed through arm 264 of seat 53 between shelf 340 and top side 264' of arm 264 at spaced intervals extending from adjacent to the front end of arm 264 toward the rear end of arm 264. With tray 54 maintained plate 186 up, side 330 is set onto shelf 340. To secure side 330 of tray 54 to arm 264 of seat 53, lever 284 is pivoted disposing key 282 in its retracted position. Tray 54 is slid along shelf 340 until key 282 registers with one of the openings 341, at which point lever 284 is released thereby causing arm 300 to pivot and move key 282 outboard of side 330 of tray 54 and into the corresponding one of the openings 341 securing side 330 of tray 54 to seat 53 at arm 264. Reversing this operation by pivoting lever 284 at handled outer end 301 of arm 300 removes key 282 from the corresponding opening 341 releasing side 330 from arm 264 of seat 53.

Openings 341 are each an engagement point for key 282. In the instant embodiment, there are three openings 341, in which the innermost opening 341 directed toward the rear end of arm 264 of seat 53 toward seat back 261 corresponds to an innermost engagement point of side 330 of tray 54 to seat 53, the outermost opening 341 directed toward the front end of arm 264 of seat 53 toward the front end of seat bottom 260 corresponds to an outermost engagement point of side 330 of tray 54 to seat 53, and the opening 341 between the innermost and outermost openings 341 corresponds to an intermediate engagement point of side 330 of tray 54 to seat 53. Although three openings 341 are employed in conjunction with arm 264, less or more can be used.

The corresponding shelf and openings formed in seat 53 at arm 265 are identical to that of shelf 340 and openings 341 formed in seat 53 at arm 264, in which pairs of opposed openings at arms 264 and 265 each correspond to an engagement point for tray 54. Like arm 264, arm 265 has a top side 265' and a tray shelf or seat is formed in the inner side of seat 53 adjacent to and just underlying top side 265' of arm 265 between top side 265' of arm 265 and seat bottom 260, and extends along substantially the entire length of arm 265 from the rear end of arm 265 at seat back 261 to the front end of arm 265 at the front end of seat bottom 260. A plurality of spaced-apart openings 340 are formed through arm 265 of seat 53 between the shelf and top side 265' of arm 264 at spaced intervals extending from adjacent to the front end of arm 265 toward the rear end of arm 265. With tray 54 maintained plate 186 up, side 331 is set onto shelf of arm 265. To secure side 331 of tray 54 to arm 265 of seat 53, lever 285 is pivoted disposing key 283 in its retracted position. Tray 54 is slid along the shelf formed in arm 265 until key 283 registers with one of the openings associated with the shelf formed in arm 265, at which point lever 285 is released thereby causing arm 310 to pivot and move key 283 outboard of side 331 of tray 54 and into the corresponding one of the openings associated with the shelf formed in arm 265 securing side 331 of tray 54 to seat 53 at arm 265. Reversing this operation by pivoting lever 285 at handled outer end 311 of arm 310 removes key 283 from the corresponding opening releasing side 331 from arm 265 of seat 53. Obviously, sides 330 and 331 are engaged to arms 264 and 265 concurrently in the course of installing tray 54.

An exemplary high chair has been disclosed, which is useful for feeding toddlers and which is elegantly designed. Tray 54 is easily attached between arms 264 and 265 of seat 53 for holding food in front of a toddler seated in seat 53, and is easily removed from arms 264 and 265 for cleaning. The latch assembly herein described used to secure tray 54 between arms 264 and 265 is simple in structure and inexpensive and easy to use representing an improvement over the complicated and expensive mechanism currently in use by prior art high chairs. Frame 60 is wheeled, which allows high chair 50 to be wheeled about as needed, such as from room-to-room within a dwelling, around the kitchen, etc. Arresting fixture 61 is readily moved between its stored position for permitting wheeled movement of high chair 50 over a surface, and its arresting position for arresting frame 60 from wheeled movement preventing high chair 50 moving about when wheeled movement of high chair 50 is not desired, such as during meals when a child sitting in high chair 50 is being fed. The provision of cylinder assembly 63 coupled between seat 53 of frame 60 provides for the convenient and efficient adjustment of seat 53 between raised and lowered positions relative to frame 60. Although cylinder assembly 63 disclosed herein is a conventional pneumatic cylinder assembly, a hydraulic cylinder assembly can be used, if desired.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A highchair, comprising:

a seat attached to a frame having a top, a bottom, and a first periphery defining a first footprint of the frame;

wheels attached to the frame adjacent to the first periphery for providing wheeled movement of the frame over a surface;

the first periphery of the frame bounding a receiving area underlying the bottom of the frame within the first footprint of the frame;

an arresting fixture having a second periphery defining a second footprint of the arresting fixture, whereby the second footprint of the arresting fixture is smaller than the first footprint of the frame;

the arresting fixture located in the receiving area whereby the second footprint is within the first footprint of the frame and is encircled by the wheels, the arresting fixture mounted to the frame for movement in reciprocal directions relative to the bottom of the frame between a first position toward the bottom of the frame, and a second position away from the bottom of the frame for engagement with the surface for arresting the frame from wheeled movement over the surface; and means interacting between the frame and the arresting fixture for moving the arresting fixture between the first and second positions.

2. The highchair according to claim 1, further comprising a cylinder assembly coupled between the seat and the frame movable between an engaged position for permitting movement of the cylinder assembly between retracted and extended conditions for moving the seat between lowered and raised positions, respectively, and a secured position for securing the cylinder assembly at a predetermined length.

3. The highchair according to claim 2, further comprising means for moving the cylinder assembly between the engaged and secured positions.

4. The highchair according to claim 1, wherein the means for moving the arresting fixture between the first and second positions comprises:

a lever mounted to the frame for pivotal movement; and a linkage assembly coupled between the lever, the frame, and the arresting fixture, whereby pivotal movement of the lever urges corresponding reciprocal movement of the arresting fixture between the lowered and raised positions.

5. The highchair according to claim 4, further comprising means for securing the arresting fixture in the raised position.

6. The highchair according to claim 5, wherein the means for securing the arresting fixture in the raised position includes at least one element carried by one of the linkage assembly and the arresting fixture, and at least one complemental element carried by the frame, whereby the element is adapted to interact with the complemental element in the raised position of the arresting fixture for securing the arresting fixture in the raised position.

7. The highchair according to claim 4, wherein the means for moving the cylinder assembly between the engaged and secured positions comprises:

a switch movable between a first position for placing the cylinder assembly in the engaged position and a second position for placing the cylinder assembly in the secured position; and a pedal operatively coupled to the switch, whereby movement of the pedal urges corresponding movement of the switch between its first and second positions.

8. The highchair according to claim 1, further comprising:

the arresting fixture comprising a plate including a parametric edge defining the second periphery of the arresting fixture, and a parametric sidewall depending downwardly from the parametric edge away from the bottom of the frame terminating with a parametric lower end; and a resilient, elastomeric, parametric boot applied to the parametric lower end of the arresting fixture for engaging the surface in the lowered position of the arresting fixture.

9. The highchair according to claim 3, further comprising:

the seat having a seat back, a seat bottom attached to the upper end of the cylinder assembly, and first and second arms each having a top side;

a first tray seat formed in the seat adjacent to the first arm between the top side thereof and the seat bottom, and a second tray seat formed in the seat adjacent to the second arm between the top side thereof and the seat bottom;

a tray, having first and second sides, adapted to sit in the first and second tray seats and extend between the arms of the seat, the first tray seat adapted to receive the first side of the tray and the second tray seat adapted to receive the second side of the tray;

a first latch coupled to the tray and configured to move between a first position engaging the seat securing the first side to the first tray seat and a second position disengaging the seat releasing the first side from the first tray seat; and a second latch coupled to the tray and configured to move between a first position engaging the seat securing the second side to the second tray seat and a second position disengaging the seat releasing the second arm from the second tray seat.

10. The highchair according to claim 9, the seat further comprising a crotch post positioned between the first and second arms, the crotch post having a lower end rigidly affixed to the seat bottom and projecting upwardly therefrom to an opposing free upper end.

11. A highchair, comprising:

a frame;

wheels attached to the frame for providing wheeled movement of the frame over a surface;

a seat having a seat back, a seat bottom, and first and second arms;

a first tray seat formed in the seat adjacent to the first arm, and a second tray seat formed in the seat adjacent to the second arm;

a tray, having first and second sides, adapted to sit in the first and second tray seats and extend between the arms of the seat, the first tray seat adapted to receive the first side of the tray and the second tray seat adapted to receive the second side of the tray;

a first latch coupled to the tray and configured to move between a first position engaging the seat securing the first side to the first tray seat and a second position disengaging the seat releasing the first side from the first tray seat;

a second latch coupled to the tray and configured to move between a first position engaging the seat securing the second side to the second tray seat and a second position disengaging the seat releasing the second arm from the second tray seat; and a cylinder coupled between the seat and the frame and movable between an engaged position for permitting movement of the cylinder assembly between retracted and extended conditions for moving the seat between lowered and raised positions, respectively, and a secured position for securing the cylinder assembly at a predetermined length.

12. The highchair according to claim 11, further comprising means for moving the cylinder assembly between the engaged and secured positions.

13. The highchair according to claim 12, wherein the means for moving the cylinder assembly between the engaged and secured positions comprises:

a switch movable between a first position for placing the cylinder assembly in the engaged position and a second position for placing the cylinder assembly in the secured position; and a pedal operatively coupled to the switch, whereby movement of the pedal urges corresponding movement of the switch between its first and second positions.

14. The highchair according to claim 11, the seat further comprising a crotch post positioned between the first and second arms, the crotch post having a lower end rigidly affixed to the seat bottom and projecting upwardly therefrom to an opposing free upper end.

15. The highchair according to claim 11, further comprising:

the frame having a top, a bottom, and a first periphery defining a first footprint of the frame;

the wheels attached to the frame adjacent to the first periphery;

the first periphery of the frame bounding a receiving area underlying the bottom of the frame within the first footprint of the frame;

an arresting fixture having a second periphery defining a second footprint of the arresting fixture, whereby the second footprint of the arresting fixture is smaller than the first footprint of the frame;

the arresting fixture located in the receiving area whereby the second footprint is within the first footprint of the frame and is encircled by the wheels, the arresting fixture mounted to the frame for movement in reciprocal directions relative to the bottom of the frame between a first position toward the bottom of the frame, and a second position away from the bottom of the frame for engagement with the surface for arresting the frame from wheeled movement over the surface; and means interacting between the frame and the arresting fixture for moving the arresting fixture between the first and second positions.

16. The highchair according to claim 15, wherein the means for moving the arresting fixture between the first and second positions comprises:

a lever mounted to the frame for pivotal movement; and a linkage assembly coupled between the lever, the frame, and the arresting fixture, whereby pivotal movement of the lever urges corresponding reciprocal movement of the arresting fixture between the lowered and raised positions.

17. The highchair according to claim 16, further comprising means for securing the arresting fixture in the raised position.

18. The highchair according to claim 17, wherein the means for securing the arresting fixture in the raised position includes at least one element carried by one of the linkage assembly and the arresting fixture, and at least one complemental element carried by the frame, whereby the element is adapted to interact with the complemental element in the raised position of the arresting fixture for securing the arresting fixture in the raised position.

19. The highchair according to claim 17, further comprising:

the arresting fixture comprising a plate including a parametric edge defining the second periphery of the arresting fixture, and a parametric sidewall depending downwardly from the parametric edge away from the bottom of the frame terminating with a parametric lower end; and a resilient, elastomeric, parametric boot applied to the parametric lower end of the arresting fixture for engaging the surface in the lowered position of the arresting fixture.

20. A highchair, comprising:

a seat attached to a frame having a top, a bottom, and a first periphery defining a first footprint of the frame;

the seat having a seat back, a seat bottom, and first and second arms;

a tray adapted to be releasably engaged to the seat for extending between the arms of the seat;

a crotch post positioned between the first and second arms of the seat, the crotch post having a lower end rigidly affixed to the seat bottom and projecting upwardly therefrom to an opposing free upper end;

wheels attached to the frame adjacent to the first periphery for providing wheeled movement of the frame over a surface;

the first periphery of the frame bounding a receiving area underlying the bottom of the frame within the first footprint of the frame;

an arresting fixture having a second periphery defining a second footprint of the arresting fixture, whereby the second footprint of the arresting fixture is smaller than the first footprint of the frame;

the arresting fixture located in the receiving area whereby the second footprint is within the first footprint of the frame and is encircled by the wheels, the arresting fixture mounted to the frame for movement in reciprocal directions relative to the bottom of the frame between a first position toward the bottom of the frame, and a second position away from the bottom of the frame for engagement with the surface for arresting the frame from wheeled movement over the surface; and means interacting between the frame and the arresting fixture for moving the arresting fixture between the first and second positions.

21. The highchair according to claim 20, further comprising a cylinder assembly coupled between the seat and the frame, the cylinder assembly movable between an engaged position for permitting movement of the cylinder assembly between retracted and extended conditions for moving the seat between lowered and raised positions, respectively, and a secured position for securing the cylinder assembly at a predetermined length.

22. The highchair according to claim 21, further comprising means for moving the cylinder assembly between the engaged and secured positions.

23. The highchair according to claim 20, wherein the means for moving the arresting fixture between the first and second positions comprises:

a lever mounted to the frame for pivotal movement; and a linkage assembly coupled between the lever, the frame, and the arresting fixture, whereby pivotal movement of the lever urges corresponding reciprocal movement of the arresting fixture between the lowered and raised positions.

24. The highchair according to claim 23, further comprising means for securing the arresting fixture in the raised position.

25. The highchair according to claim 24, wherein the means for securing the arresting fixture in the raised position includes at least one element carried by one of the linkage assembly and the arresting fixture, and at least one complemental element carried by the frame, whereby the element is adapted to interact with the complemental element in the raised position of the arresting fixture for securing the arresting fixture in the raised position.

26. The highchair according to claim 22, wherein the means for moving the cylinder assembly between the engaged and secured positions comprises:

a switch movable between a first position for placing the cylinder assembly in the engaged position and a second position for placing the cylinder assembly in the secured position; and a pedal operatively coupled to the switch, whereby movement of the pedal urges corresponding movement of the switch between its first and second positions.

27. The highchair according to claim 20, further comprising:

the arresting fixture comprising a plate including a parametric edge defining the second periphery of the arresting fixture, and a parametric sidewall depending downwardly from the parametric edge away from the bottom of the frame terminating with a parametric lower end; and a resilient, elastomeric, parametric boot applied to the parametric lower end of the arresting fixture for engaging the surface in the lowered position of the arresting fixture.

* * * * *